US008459642B2

(12) United States Patent
Suzuki

(10) Patent No.: US 8,459,642 B2
(45) Date of Patent: Jun. 11, 2013

(54) SHEET CONVEYING APPARATUS AND IMAGE FORMING APPARATUS

(75) Inventor: Yohei Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/339,775

(22) Filed: Dec. 29, 2011

(65) Prior Publication Data

US 2012/0181744 A1 Jul. 19, 2012

(30) Foreign Application Priority Data

Jan. 13, 2011 (JP) ..... 2011-004917

(51) Int. Cl.
*B65H 9/00* (2006.01)

(52) U.S. Cl.
USPC ..... 271/245; 271/226

(58) Field of Classification Search
USPC ..... 271/243, 244, 245, 246, 226
See application file for complete search history.

(56) References Cited

U.S. PATENT DOCUMENTS

| | | | | |
|---|---|---|---|---|
| 5,027,160 | A | 6/1991 | Okada et al. | |
| 5,153,655 | A | 10/1992 | Suzuki et al. | |
| 6,011,948 | A | 1/2000 | Amano et al. | |
| 6,113,093 | A | 9/2000 | Morinaga et al. | |
| 7,077,517 | B2 | 7/2006 | Awai et al. | |
| 7,681,882 | B2 * | 3/2010 | Yu et al. | 271/243 |
| 8,123,217 | B2 * | 2/2012 | Otaka | 271/245 |
| 8,240,666 | B2 * | 8/2012 | Cheng | 271/245 |
| 8,308,159 | B1 * | 11/2012 | Manor et al. | 271/245 |
| 2008/0093795 | A1 * | 4/2008 | Lee et al. | 271/245 |
| 2008/0143045 | A1 * | 6/2008 | Yu et al. | 271/245 |
| 2010/0134552 | A1 | 6/2010 | Suzuki et al. | |
| 2010/0148426 | A1 | 6/2010 | Saito et al. | |

FOREIGN PATENT DOCUMENTS

EP 0 782 967 B1 6/2002

OTHER PUBLICATIONS

U.S. Appl. No. 13/252,303, filed Oct. 4, 2011, Yohei Suzuki.
U.S. Appl. No. 13/339,744, filed Dec. 29, 2011, Yohei Suzuki.
U.S. Appl. No. 13/410,495, filed Mar. 2, 2012, Kenji Watanabe et al.

* cited by examiner

*Primary Examiner* — Kaitlin Joerger
(74) *Attorney, Agent, or Firm* — Fitzpatrick, Cella, Harper & Scinto

(57) ABSTRACT

The present invention relates to a sheet conveying apparatus, comprising: a conveying portion conveying a sheet; a shutter member having an abutting surface for abutting the sheet to correct skew feeding; a biasing member for biasing the shutter member to position at a first position where the leading end abuts against the abutting surface; and a support mechanism which movably supports the shutter member to move in an order of the first position, a second position to which the shutter member moves by the sheet against biasing from the biasing member, and a third position where the shutter member abuts the sheet and stands by to move to the first position when a trailing end of the sheet passes the shutter member, while keeping the abutting surface facing upstream.

17 Claims, 28 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus including the sheet conveying apparatus. In particular, the present invention relates to an image forming apparatus including a sheet conveying apparatus capable of correcting skew feeding of a sheet to be conveyed.

2. Description of the Related Art

In a typical image forming apparatus, the accuracy of a recording position of an image on a sheet (hereinafter referred to as "recording accuracy") is one of important factors in terms of maintenance of the image quality. For this reason, when a sheet to be conveyed is skew-fed upon image formation, for example, it is necessary to correct the skew-fed sheet to an appropriate sheet position. Thus, various sheet conveying apparatuses having a skew feeding correction function are proposed as related-art image forming apparatuses to improve the recording accuracy (see U.S. Pat. No. 6,011,948).

For example, in a sheet conveying apparatus disclosed in U.S. Pat. No. 6,011,948, plural pairs of conveying rollers are provided in a sheet width direction orthogonal to a sheet conveying direction, and a shutter member is disposed to be rotatable about a rotation shaft of each conveying roller between the pair of conveying rollers. The shutter member includes an abutting portion against which a sheet abuts. When a leading end of a sheet abuts against the abutting portion, the sheet is loosened by a reaction force from the abutting portion, thereby forming a curved loop. The formation of this loop allows the leading end of the sheet to be aligned in parallel with the sheet width direction orthogonal to the conveying direction, thereby correcting skew feeding. After that, when the shutter member rotates, the sheet is conveyed while the leading end of the sheet is nipped by a nip portion between a pair of conveying rollers in a state of being aligned in parallel with the width direction. In short, the sheet is conveyed in the state where the skew feeding of the sheet is corrected.

In recent years, along with an increasing demand for an improvement in throughput of image forming apparatus, there is a demand for an improvement in sheet conveying speed and a reduction in distance from a trailing end of a preceding sheet to a leading end of a subsequent sheet (hereinafter referred to as "a distance between sheets"). Accordingly, after the preceding sheet passes, it is necessary to return the shutter member to a home position (a position where a leading end of a skew-fed sheet is allowed to abut against the abutting portion to thereby correct skew feeding).

FIGS. 27 and 28 illustrate a shutter member 523 provided in a sheet conveying apparatus of a prior art. As illustrated in FIGS. 27 and 28, the shutter member 523 of the prior art is rotatably supported by a rotation shaft 518*a* on one side of a pair of conveying rollers 518 and 519. The shutter member 523 guides a sheet S to allow the sheet to pass through a nip portion between the pair of conveying rollers 518 and 519. After that, the shutter member 523 is rotated to return to an abutting position to allow the sheet to pass through the nip portion between the pair of conveying rollers 518 and 519. Therefore, a required minimum distance between sheets is a distance D3 which is obtained by adding a distance D1 from a position where the trailing end of the preceding sheet S passes through the abutting surface of the shutter member 523 to the home position where the skew feeding of the sheet S is corrected, and a distance D2 at which the subsequent sheet S is conveyed to the home position.

Since the shutter member 523 reciprocatingly moves so as to pass through the nip portion between the pair of conveying rollers 518 and 519, the distance D1 is generated and a time Δt is necessary for the shutter member 523 to move the distance D1. On the other hand, the distance D2 is a distance (Δt×V) obtained by multiplying the time Δt necessary for the shutter member 523 to move the distance D1, by a conveying speed V of the sheet S, and the distance increases along with an increase in the conveying speed of the sheet S. Accordingly, the sheet conveying apparatus of the prior art has a problem in that the distance between sheets increases as an increase in the conveying speed of the sheet S, which hinders a further improvement in throughput.

Therefore, the present invention provides a sheet conveying apparatus capable of suppressing an increase in a distance between sheets and improving throughput even when the sheet convey speed is increased, and an image forming apparatus including the sheet conveying apparatus.

SUMMARY OF THE INVENTION

The present invention relates to a sheet conveying apparatus, comprising: a conveying portion which conveys a sheet; a shutter member having an abutting surface that abuts against a leading end of the sheet to correct skew feeding of the sheet conveyed by the conveying portion; a biasing member which applies a biasing force to the shutter member to position at a first position where the leading end abuts against the abutting surface; and a support mechanism which movably supports the shutter member such that the shutter member moves in an order of the first position, a second position to which the shutter member moves by the sheet being conveyed against the biasing force of the biasing member, and a third position where the shutter member abuts the surface of the sheet being conveyed and stands by to move to the first position when a trailing end of the sheet passes the shutter member, while keeping the abutting surface facing upstream in a sheet conveying direction.

According to an aspect of the present invention, a time necessary for positioning a shutter member at a first position after passage of a sheet can be shortened to reduce the need for securing a long distance between sheets, thereby improving throughput.

Further features of the present invention will become apparent from the following description of exemplary embodiments with reference to the attached drawings.

DESCRIPTION OF THE EMBODIMENTS

An image forming apparatus including a sheet conveying apparatus according to an embodiment of the present invention will be described below with reference to the accompanying drawings. The image forming apparatus according to the present invention is an image forming apparatus having a skew feeding correction function capable of correcting skew feeding of a sheet to be conveyed, such as a copying machine, a printer, a facsimile, or a composite device thereof. In the following embodiments, an electrophotographic color image forming apparatus 100 for forming four color toner images will be described.

First Embodiment

Figure 1:
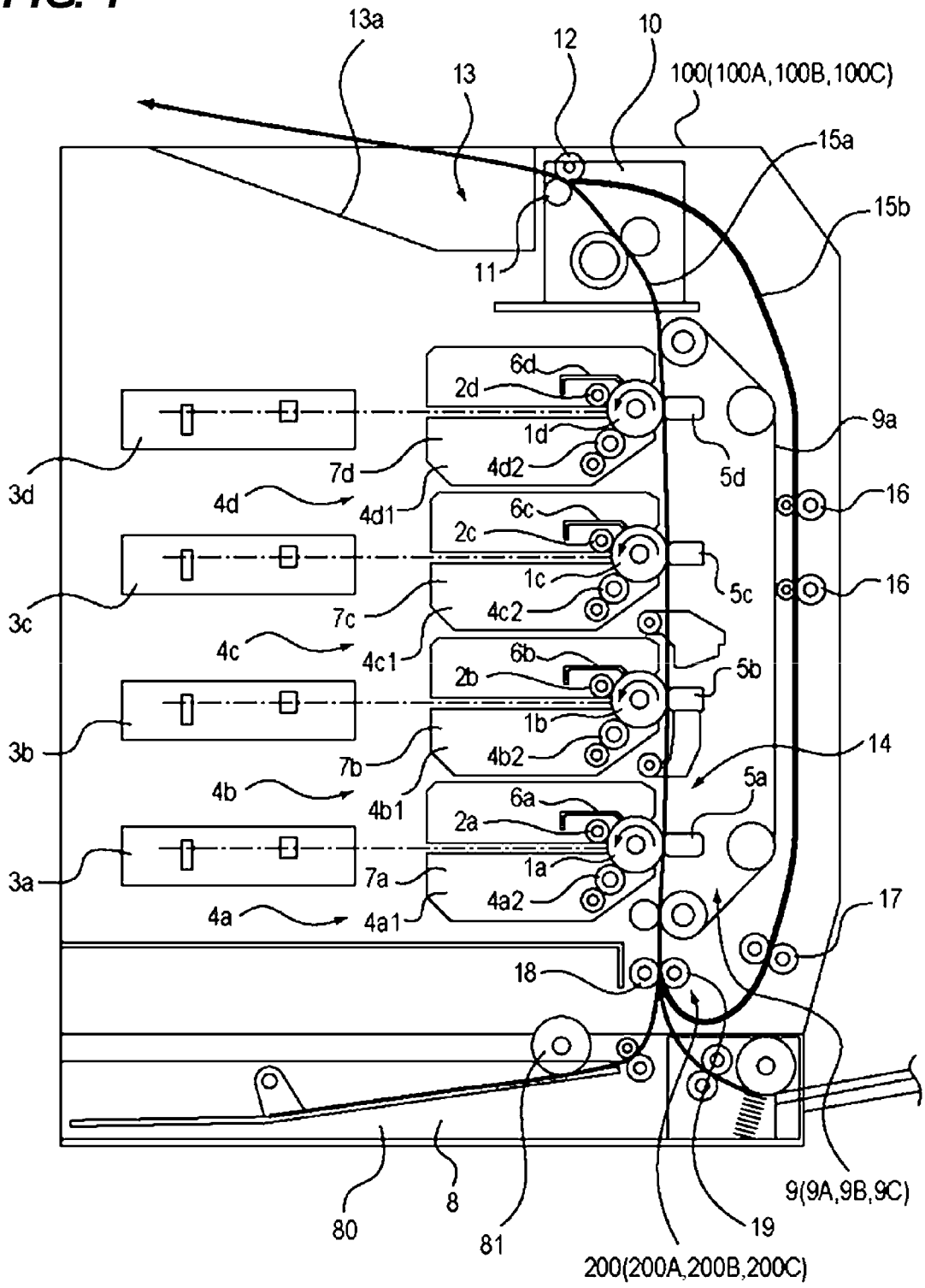
FIG. 1 is a sectional view schematically illustrating an overall structure of an image forming apparatus according to a first embodiment of the present invention.

The image forming apparatus 100 according to a first embodiment of the present invention will be described with reference to FIGS. 1 to 12B. First, the overall structure of the image forming apparatus 100 according to the first embodiment will be described with reference to FIG. 1. FIG. 1 is a sectional view schematically illustrating the overall structure of the image forming apparatus 100 according to the first embodiment of the present invention.

As illustrated in FIG. 1, the image forming apparatus 100 according to the first embodiment includes a sheet conveying portion 8 for feeding sheets S, an image forming portion 14 for forming a toner image, a fixing portion 10 for fixing a transferred unfixed toner image, and a sheet conveying portion 9 serving as a sheet conveying apparatus. The image forming apparatus 100 also includes a sheet discharge portion 13 for discharging the sheets S having the toner image fixed thereon.

The sheet conveying portion 8 includes a sheet cassette 80 for containing the sheets S, a feed roller 81 for feeding the sheet S contained in the sheet cassette 80 to the sheet conveying portion 9, and a separation portion (not illustrated) for separating the sheets S one by one. The sheet conveying portion 8 feeds the sheets S contained in the sheet cassette 80 to the sheet conveying portion 9 by the feed roller 81 while the sheets S are separated one by one by the separation portion.

The image forming portion 14 forms a toner image based on predetermined image information, and transfers the toner image onto each sheet S conveyed by the sheet conveying portion 9. The image forming portion 14 includes photosensitive drums 1*a*, 1*b*, 1*c*, and 1*d*, charging portions 2*a*, 2*b*, 2*c*, and 2*d*, exposure portions 3*a*, 3*b*, 3*c*, and 3*d*, development portions 4*a*, 4*b*, 4*c*, and 4*d*, transfer rollers 5*a*, 5*b*, 5*c*, and 5*d*, and cleaning portions 6*a*, 6*b*, 6*c*, and 6*d*. The image forming portion 14 also includes a transfer belt 9*a*.

The photosensitive drums 1*a* to 1*d* each serving as an image bearing member are formed by applying an organic photo conductive layer (OPC) to an outer peripheral surface of a cylinder made of aluminum. Both ends of each of the photosensitive drums 1*a* to 1*d* are rotatably supported by a flange. A driving force from a drive motor (not illustrated) is transmitted to one end of each of the photosensitive drums 1*a* to 1*d*, thereby rotationally driving the photosensitive drums 1*a* to 1*d* counterclockwise as illustrated in FIG. 1. The charging portions 2*a* to 2*d* allow conductive rollers, which are each formed in a roller shape, to abut against the surface of each of the photosensitive drums 1*a* to 1*d*, thereby applying a charge bias voltage supplied by a power supply (not illustrated) to uniformly charge the surface of each of the photosensitive drums 1*a* to 1*d*. The exposure portions 3*a* to 3*d* apply laser beams based on image information to form electrostatic latent images on the photosensitive drums 1*a* to 1*d*.

The development portions 4*a* to 4*d* respectively include toner containing portions 4*a*1, 4*b*1, 4*c*1, and 4*d*1 and development roller portions 4*a*2, 4*b*2, 4*c*2, and 4*d*2. The toner containing portions 4*a*1 to 4*d*1 respectively contain toners of black, cyan, magenta, and yellow. The development roller portions 4*a*2 to 4*d*2 are arranged to be adjacent to each other on the surface of the photosensitive member, and apply a development bias voltage to allow the toner of each color to adhere to the electrostatic latent images on the photosensitive drums 1*a* to 1*d*, thereby visualizing the electrostatic latent images as toner images.

The transfer rollers 5*a* to 5*d* are arranged inside the transfer belt 9*a* so as to be opposed to the photosensitive drums 1*a* to 1*d* and abut against the transfer belt 9*a*. The transfer rollers 5*a* to 5*d* are connected to a power supply for transfer bias (not illustrated), and positive charges from the transfer rollers 5*a* to 5*d* are applied to the sheet S through the transfer belt 9*a*. Owing to this electric field, negative color images formed on the photosensitive drums 1*a* to 1*d* are sequentially transferred onto the sheet S in contact with the photosensitive drums 1*a* to 1*d*, thereby forming color images. The cleaning portions 6*a* to 6*d* remove residual toner on the surface of the photosensitive drums 1*a* to 1*d* after the transfer.

In this embodiment, the photosensitive drums 1*a* to 1*d*, the charging portions 2*a* to 2*d*, the development portions 4*a* to 4*d*, and the cleaning portions 6*a* to 6*d* integrally form process cartridge portions 7*a* to 7*d*.

The fixing portion 10 heats the sheet S having an unfixed toner image transferred thereon, and fixes the unfixed toner image. The sheet discharge portion 13 includes a pair of discharge rollers 11 and 12, which allows the sheet S having the image formed thereon to be forwardly rotated and conveyed or reversely rotated and reversed, and a discharge portion 13*a* which discharges the sheet S having the image formed thereon.

The sheet conveying portion 9 conveys the sheet S and the like having the toner image formed thereon by the image forming portion 14. The sheet conveying portion 9 includes a sheet conveying path 15*a*, a duplex conveying path 15*b*, a pair of skew conveying rollers 16, a pair of U-turn rollers 17 also serving as a conveying portion, and a skew feeding correction portion 200.

The sheet conveying path 15*a* is a conveying path for conveying the sheet S fed from the sheet conveying portion 8, the sheet S conveyed from the duplex conveying path 15*b*, and the like. The toner image formed by the image forming portion 14 is transferred at a predetermined position. The duplex conveying path 15*b* is a conveying path for conveying the sheet S, which has been reversed by the pair of discharge rollers 11 and 12 to perform duplex printing, to the sheet conveying path 15*a*. The pair of skew conveying rollers 16 is disposed on the duplex conveying path 15*b* and conveys the reversed sheet S. The pair of U-turn rollers 17 is disposed on the duplex conveying path 15*b*, and conveys again the sheet S to be conveyed through the duplex conveying path 15*b* to the sheet conveying path 15*a*.

The skew feeding correction portion 200 is provided on the sheet conveying path 15*a*, and allows the sheet S fed from the sheet conveying portion 8 or the sheet S conveyed from the duplex conveying path 15*b* to form a loop, thereby correcting skew feeding of the sheet S.

The sheet S fed from the sheet conveying portion 8 to the sheet conveying path 15*a* is conveyed to the image forming portion 14 through the skew feeding correction portion 200, and the respective color toner images are sequentially transferred by the image forming portion 14. After that, the fixing portion 10 fixes the unfixed toner image, and the pair of discharge rollers 11 and 12 discharges the sheet to the sheet discharge portion 13.

Upon duplex printing, after the fixing portion 10 fixes the unfixed toner image, the pair of discharge rollers 11 and 12 is reversely rotated before the sheet is discharged to the sheet discharge portion 13 by the pair of discharge rollers 11 and 12. As a result, the sheet S on one side of which the toner image is fixed is conveyed to the duplex conveying path 15*b* in the reversed state. The sheet S conveyed to the duplex conveying path 15*b* forms a loop in the skew feeding correction portion 200 through the pair of skew conveying rollers 16 and the pair of U-turn rollers 17, thereby correcting skew feeding of the sheet. Then, the sheet is conveyed to the image forming portion again, and duplex printing is carried out.

Figure 2A:
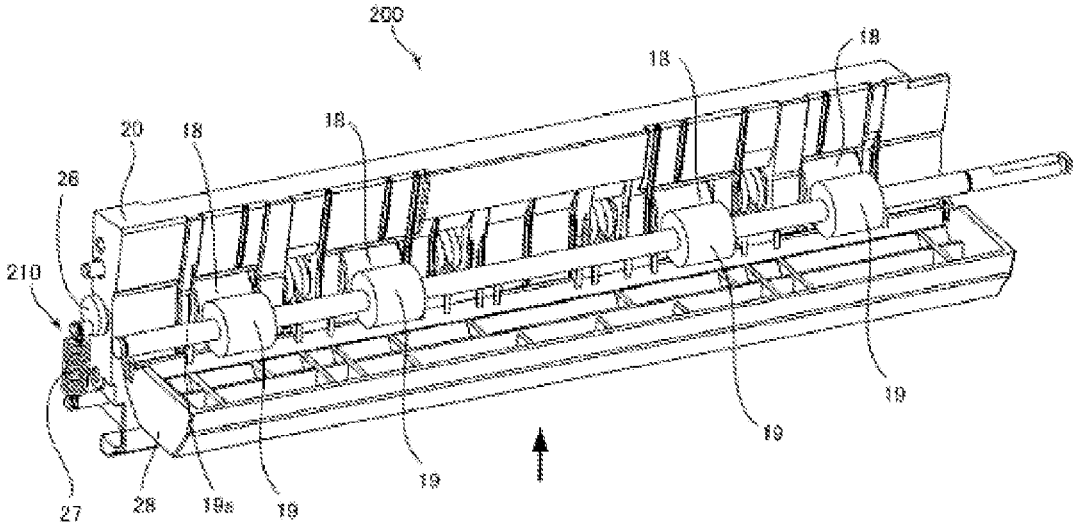
FIG. 2 is a perspective view of a skew feeding correction portion according to the first embodiment.
FIG. 2B is a perspective view illustrating the skew feeding correction portion illustrated in FIG. 2A, viewed from the opposite side.
Figure 2B:
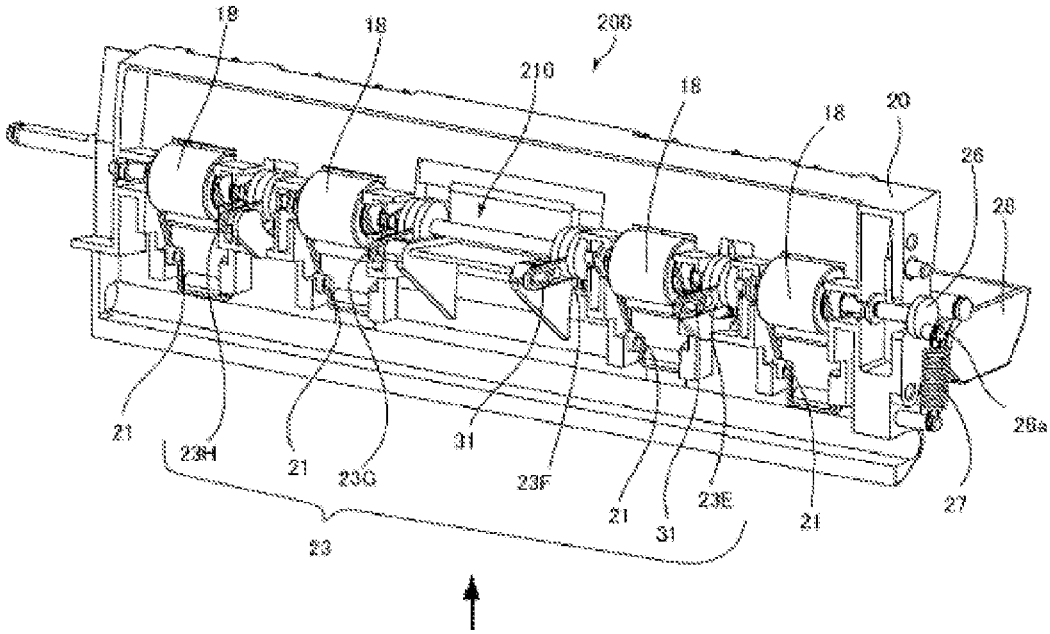
Figure 3A:
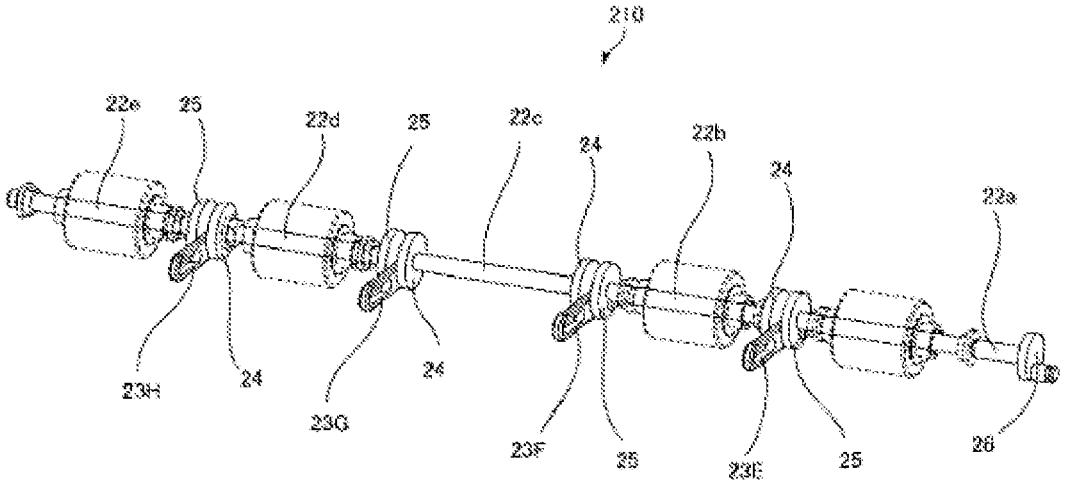
FIG. 3A is a perspective view illustrating a part of a shutter portion of the skew feeding correction portion according to the first embodiment.
Figure 3B:
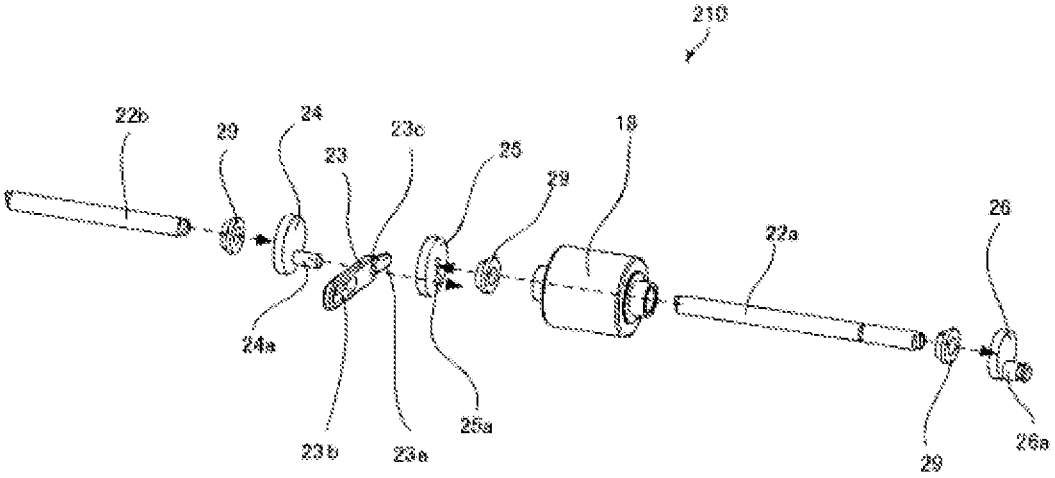
FIG. 3B is an exploded perspective view illustrating a part of the shutter portion illustrated in FIG. 2A.
Figure 4A:
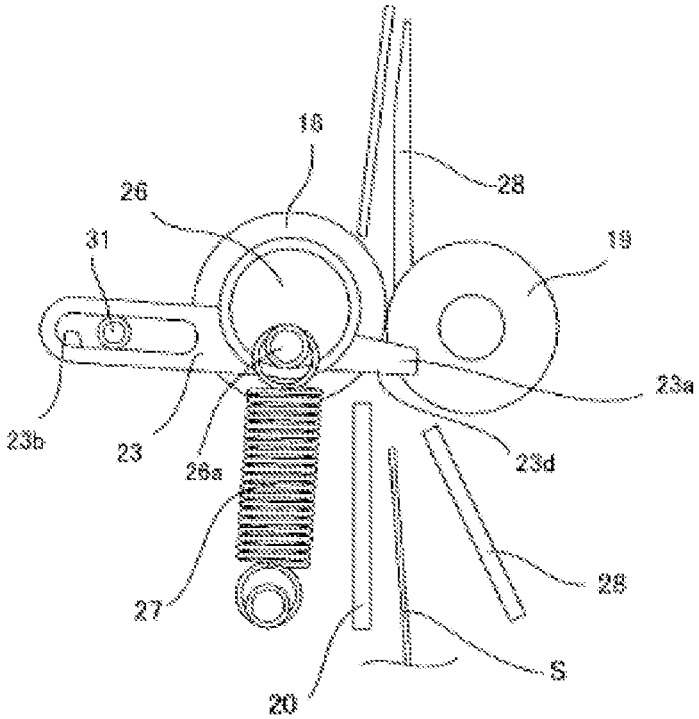
FIG. 4A is a diagram illustrating the skew feeding correction portion in a state where a sheet is conveyed.

Next, the skew feeding correction portion 200 for correcting the skew feeding of the sheet S will be described with reference to FIGS. 2A to 14 besides FIG. 1. First, the overall structure of the skew feeding correction portion 200 will be described with reference to FIGS. 1 to 4A. FIG. 2A is a perspective view of the skew feeding correction portion 200 according to the first embodiment. FIG. 2B is a perspective view of the skew feeding correction portion 200 illustrated in FIG. 2A, viewed from the opposite side. FIG. 3A is a perspective view illustrating a part of a shutter portion 210 of the skew feeding correction portion 200 according to the first embodiment. FIG. 3B is an exploded perspective view illustrating a part of the shutter portion 210 illustrated in FIG. 3A. FIG. 4A is a diagram illustrating the skew feeding correction portion 200 in a state where the sheet S is conveyed. Each arrow illustrated in FIGS. 2A and 2B indicates the conveying direction of the sheet S.

As illustrated in FIGS. 2A to 4B, the skew feeding correction portion 200 includes plural pairs of rollers 18 and 19, a sheet frame 20, plural conveying roller springs 21, a guide frame 28, and the shutter portion 210.

As illustrated in FIGS. 2A and 2B, the plural pairs of rollers 18 and 19 include plural conveying rollers 19 and plural conveying rollers 18 which are disposed in a state of being brought into press contact with the plural conveying rollers 19. The conveying rollers 19 are fixed to a rotation shaft 19*a*, which is axially supported in parallel with a rotation shaft (not illustrated) of each of the photosensitive drums 1*a* to 1*d* (see FIG. 1), and rotate integrally with the rotation shaft 19*a*. The convey rollers 18 are rotatably mounted to plural shutter shafts 22*a*, 22*b*, 22*c*, 22*d*, and 22*e* respectively, as described later, through a bearing 29 (see FIGS. 3A and 3B), and are brought into press contact with the conveying roller 19 by the conveying roller springs 21 fixed to the sheet frame 20. The convey rollers 18 are brought into press contact with the conveying rollers 19 by a pressing force of each conveying roller spring 21, thereby forming a follower rotating member of each of the conveying rollers 19 for conveying the sheet S. Further, a gap is formed between the inner peripheral surface of each of the convey rollers 18 and the outer peripheral surface of each of the shutter shafts 22*a* to 22*e*, thereby preventing a spring force of each conveying roller spring 21 from being transmitted to the shutter shafts 22*a* to 22*e*. This structure prevents the spring force of each conveying roller spring 21 from inhibiting the rotation operations of plural shutter members 23E, 23F, 23G, and 23H, which are fixed to the shutter shafts 22*a* to 22*e* and the like as described later.

As illustrated in FIG. 4A, the sheet frame 20 and the guide frame 28 regulate the both sides of the sheet S in the thickness direction on the upstream side of the shutter portion 210, and guide the sheet S conveyed through the sheet conveying path 15*a* toward the pair of rollers 18 and 19. The sheet frame 20 and the guide frame 28 include a loop formation portion 32 (see FIG. 7B described later) which is spaced apart at a predetermined distance so that the sheet S can form a loop curved in the thickness direction of the sheet S after the sheet S abuts against an abutting surface 23*d* described later. The sheet S conveyed to the skew feeding correction portion 200 forms a loop in the loop formation portion 32, thereby correcting the skew feeding of the sheet S.

The shutter portion 210 includes the plural shutter shafts 22*a* to 22*e*, the plural shutter members 23E to 23H, plural spindles 31 constituting a support mechanism, and plural pairs of rotating members 24 and 25 serving as a rotating member constituting the support mechanism. The shutter portion 210 includes a shutter drive member 26 serving as a connecting rotation member, and a shutter spring 27 serving as a biasing member. The support mechanism movably supports the shutter portion 210 so that the shutter portion 210 can perform a crank-movement.

The plural shutter shafts 22*a* to 22*e* are disposed in parallel with the rotation axis direction of the photosensitive drums 1*a* to 1*d*, and are connected through the plural pairs of rotating members 24 and 25. The plural shutter shafts 22*a* to 22*e* thus connected are rotatably supported on the sheet frame 20 with the direction orthogonal to the sheet conveying direction as a rotation axis. The connected shutter shafts 22*a* to 22*e* are hereinafter collectively referred to as the shutter shaft 22.

The plural shutter members 23E to 23H are formed in the same shape. Accordingly, each of the plural shutter members 23E to 23H will be described below as the shutter member 23. The shutter member 23 includes a main body portion 23*e* formed in a long plate shape (linear shape), an abutting portion 23*a* formed integrally with the main body portion 23*e* at one end in the longitudinal direction of the main body portion 23*e*, and a long hole portion 23*b* formed on the other end side. The shutter member 23 also includes a connected portion 23*c* formed between the abutting portion 23*a* and the long hole portion 23*b*.

The abutting portion 23*a* includes the abutting surface 23*d* against which the leading end of the sheet S conveyed through the sheet conveying path 15*a* may abut. The abutting surface 23*d* abuts against the leading end of the sheet S and is engaged with the sheet S before the sheet S enters into a nip portion between the pair of rollers 18 and 19. That is, the abutting portion 23*a* is disposed in a state of protruding to the sheet conveying path so as to be positioned on the upstream side of the nip portion between the pair of rollers 18 and 19, until the leading end of the sheet S abuts against the abutting surface 23*d*. A position where the leading end of the sheet S may abut against the abutting surface 23*d* on the upstream side in the sheet conveying direction is referred to as a "first position".

The long hole portion 23*b* is formed along the longitudinal direction of the main body portion 23*e* at the other end of the main body portion 23*e*, and is slidably engaged with each spindle 31 which is positioned to be fixed to the sheet frame 20 (see FIG. 2B). The connected portion 23*c* is connected to the pair of rotating members 24 and 25 so that the shutter member 23 can rotate with the pair of rotating members 24 and 25. Each spindle 31 constitutes a slide support portion that slidably supports the main body portion 23*e* of the shutter member 23.

The plural pairs of rotating members 24 and 25 are formed in a disc shape, and are respectively connected to the plural shutter shafts 22*a* to 22*e* so that each rotation center matches the rotation shaft of the shutter shaft 22. In this embodiment, a D-shaped portion formed at the leading end of each of the plural shutter shafts 22*a* to 22*e* is pressed into a D-cut hole formed at the rotation center of the pair of rotating members 24 and 25, thereby connecting the plural pairs of rotating members 24 and 25 with the plural shutter shafts 22*a* to 22*e*. The rotating member 24 has a connecting shaft 24*a* formed so as to protrude as a connection portion that penetrates the connected portion 23*c* of the shutter member 23 at a position (decentered position) radially offset from the rotation center of the rotating member 24. The rotating member 25 has a connection hole 25*a* for connecting the connecting shaft 24*a* penetrating through the connected portion 23*c*. The connection hole 25*a* is formed at a position (decentered position) radially offset from the rotation center of the rotating member 25. The pair of rotating members 24 and 25 is connected with the shutter member 23 by allowing the connecting shaft 24*a* provided at the position eccentric from the rotation center to penetrate through the connected portion 23*c*.

The shutter drive member 26 is formed in a disc shape, and is fixed to an end of the shutter shaft 22 so that the rotation shaft of the shutter shaft 22 matches the rotation center of the shutter drive member 26. The shutter drive member 26 includes a connecting support portion 26*a* formed so as to protrude at the position (decentered position) radially offset from the rotation center. The connecting support portion 26*a* is connected to one end of the shutter spring 27 and is provided so that the abutting surface 23*d* is positioned at the first position when the shutter spring 27 is in a minimum biasing state (non-extended state).

One end of the shutter spring 27 is connected to the connecting support portion 26*a* of the shutter drive member 26, and the other end of the shutter spring 27 is positioned to be fixed onto the sheet frame 20 and joins the shutter drive member 26 and the sheet frame 20. The shutter spring 27 applies a force to the shutter member 23 through the shutter drive member 26, the shutter shaft 22, and the pair of rotating members 24 and 25 so that the abutting surface 23*d* is positioned at the first position. For example, the shutter spring 27 applies a force to the shutter member 23, which is pressed by the leading end of the sheet S and rotated in a Z2 direction (see FIG. 8A described later) through the shutter drive member 26, thereby positioning the abutting portion 23*a* at the first position. In other words, as illustrated in FIG. 4A, the shutter spring 27 applies a force to the shutter member 23 so that the abutting surface 23*d* is positioned at the first position at a bottom dead center (balanced state) of the connecting support portion 26*a* of the shutter drive member 26.

Figure 4B:
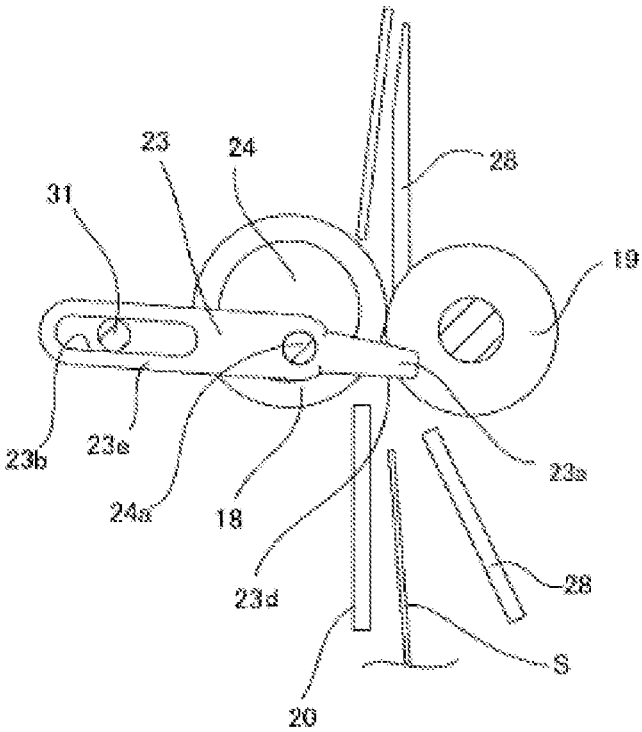
FIG. 4B is a diagram illustrating the shutter member in a state where a sheet is conveyed to the skew feeding correction portion.
Figure 5A:
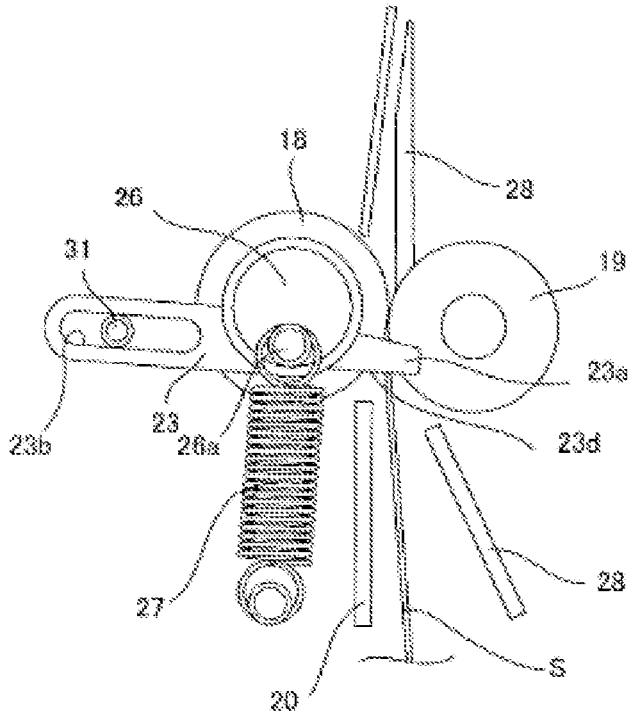
FIG. 5A is a diagram illustrating the skew feeding correction portion in a state where a leading end of a sheet abuts against an abutting surface of the shutter member.
Figure 5B:
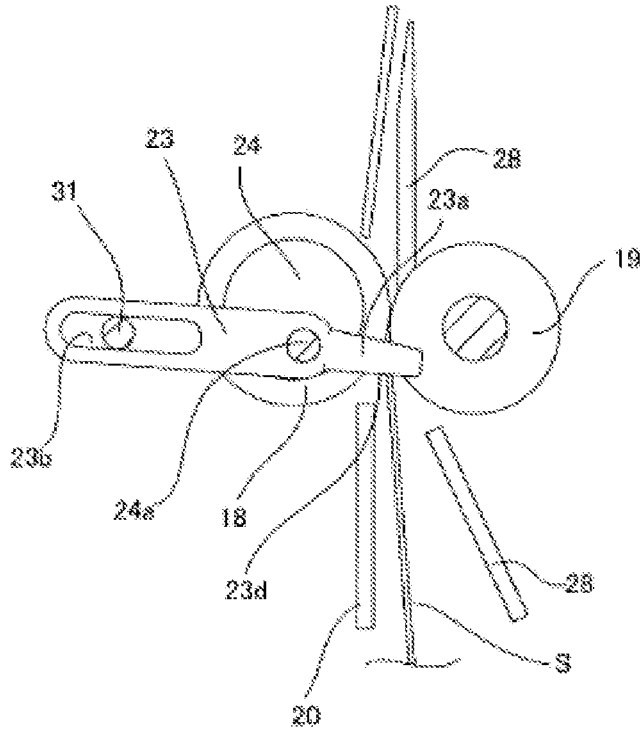
FIG. 5B is a diagram illustrating the shutter member in a state where a leading end of a sheet abuts against the abutting surface.
Figure 6A:
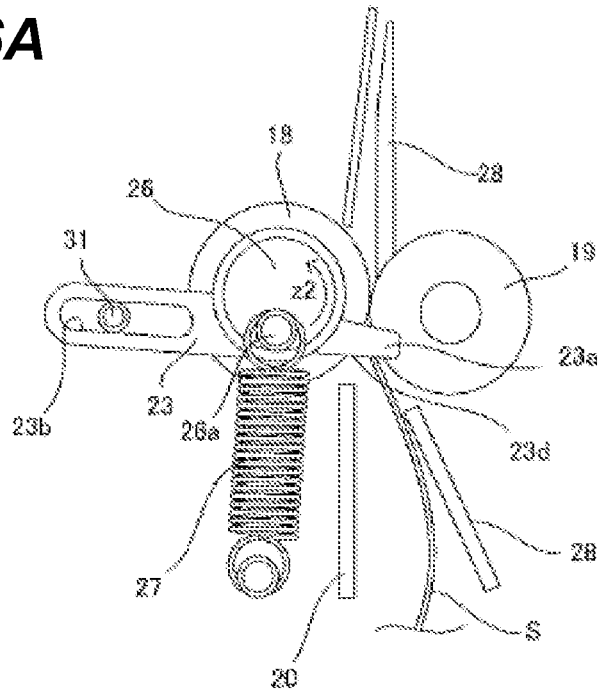
FIG. 6A is a diagram illustrating the skew feeding correction portion in a state where a leading end of a sheet abuts against the abutting surface of the shutter member and the sheet forms a loop.
Figure 6B:
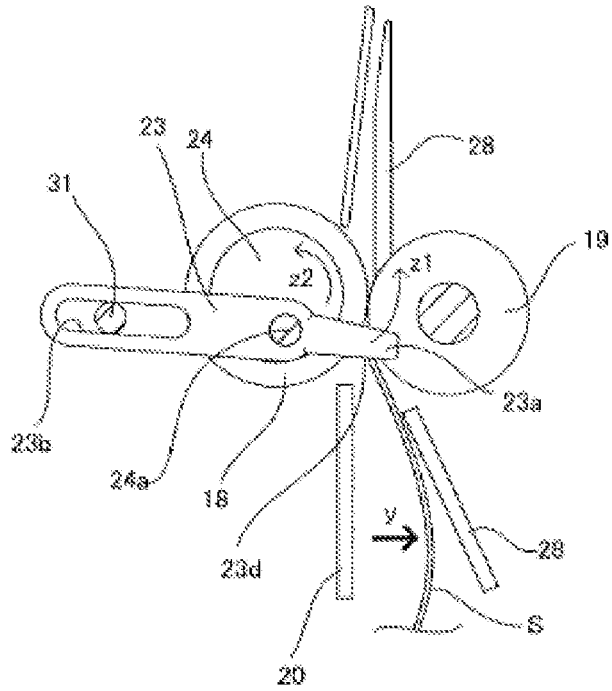
FIG. 6B is a diagram illustrating the shutter member in a state where a leading end of a sheet abuts and the sheet forms a loop.

Next, the operation of the skew feeding correction portion 200 will be described with reference to FIGS. 4A to 13A besides FIGS. 1 and 4A. FIG. 4B is a diagram illustrating the shutter member 23 in a state where the sheet S is conveyed to the skew feeding correction portion 200. FIG. 5A is a diagram illustrating the skew feeding correction portion 200 in a state where the leading end of the sheet S abuts against the abutting surface 23*d* of the shutter member 23. FIG. 5B is a diagram illustrating the shutter member 23 in a state where the leading end of the sheet S abuts against the abutting surface 23*d*. FIG. 6A is a diagram illustrating the skew feeding correction portion 200 in a state where the leading end of the sheet S abuts against the abutting surface 23*d* of the shutter member 23 and the sheet S forms a loop. FIG. 6B is a diagram illustrating the shutter member 23 in a state where the leading end of the sheet S abuts and the sheet S forms a loop.

Figure 7A:
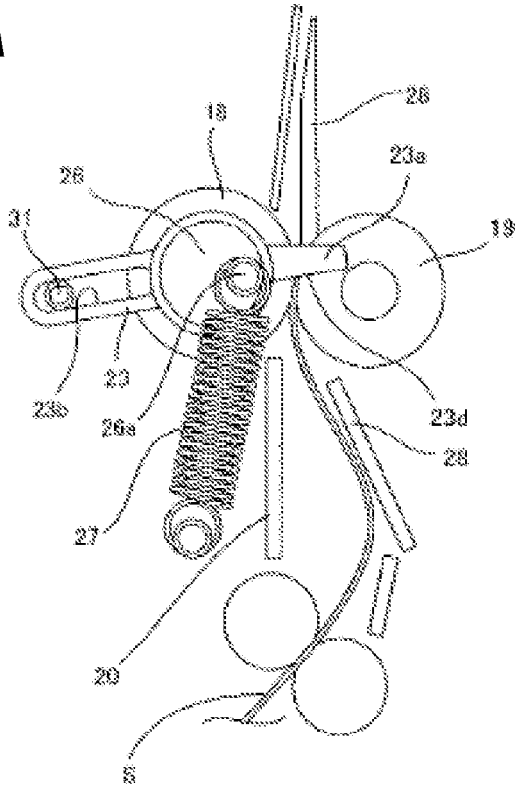
FIG. 7A is a diagram illustrating the skew feeding correction portion in a state where the abutting surface of the shutter member is pressed against a sheet forming a loop and the shutter member rotates.
Figure 7B:
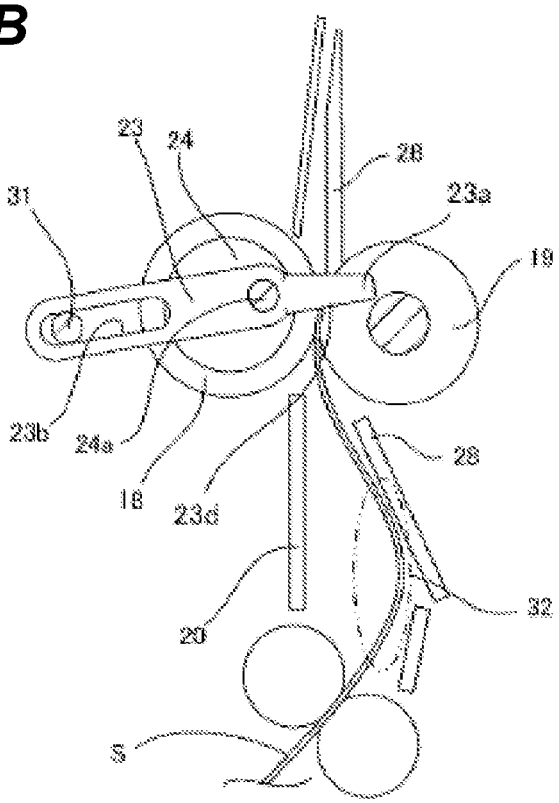
FIG. 7B is a diagram illustrating the shutter member in a state of being pressed against the sheet forming a loop and rotated.
Figure 8A:
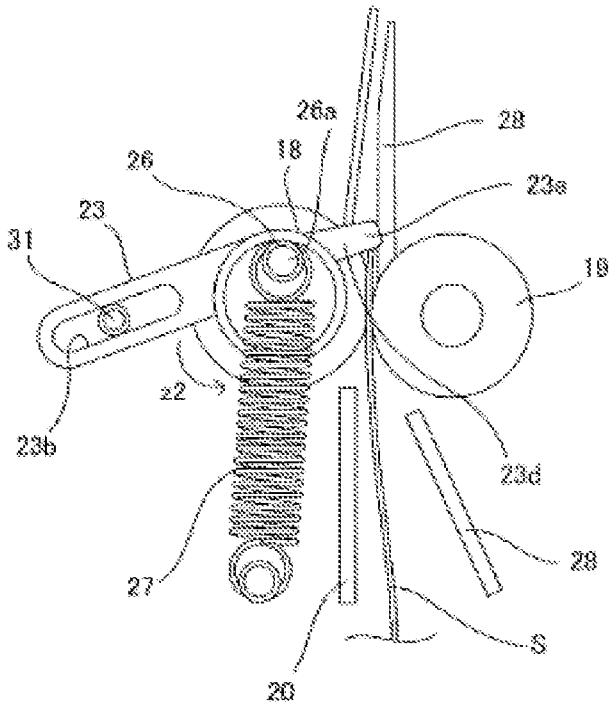
FIG. 8A is a diagram illustrating the skew feeding correction portion in a state where the shutter member rotates and a sheet is nipped by a nip portion.
Figure 8B:
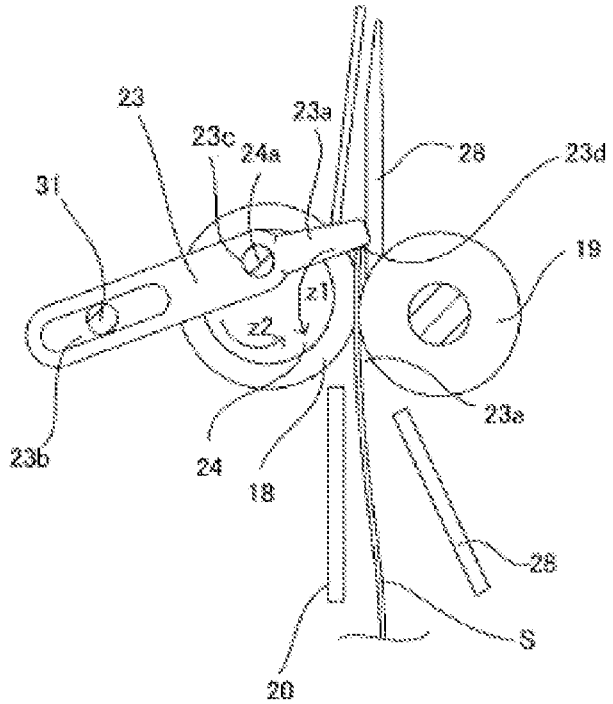
FIG. 8B is a diagram illustrating the shutter member in a state where a sheet is nipped by the nip portion.
Figure 9A:
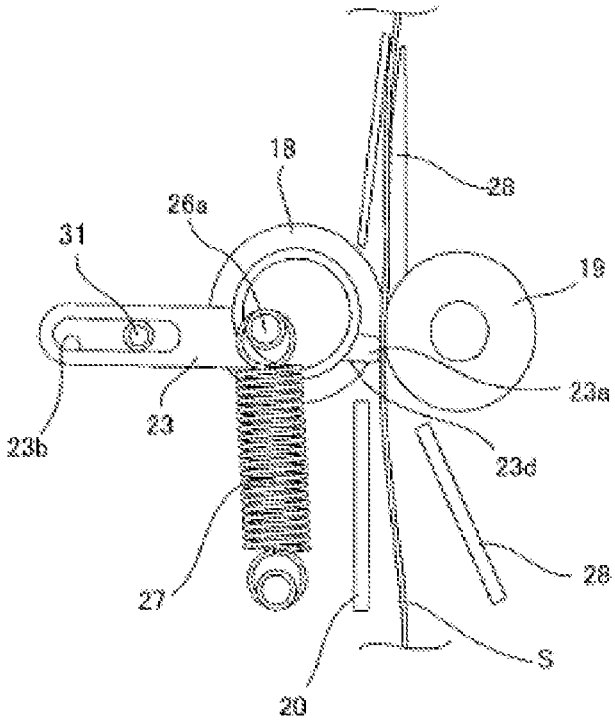
FIG. 9A is a diagram illustrating the skew feeding correction portion that stands by in a state where a leading end of the abutting portion of the shutter member abuts against the surface of a sheet to be conveyed.
Figure 9B:
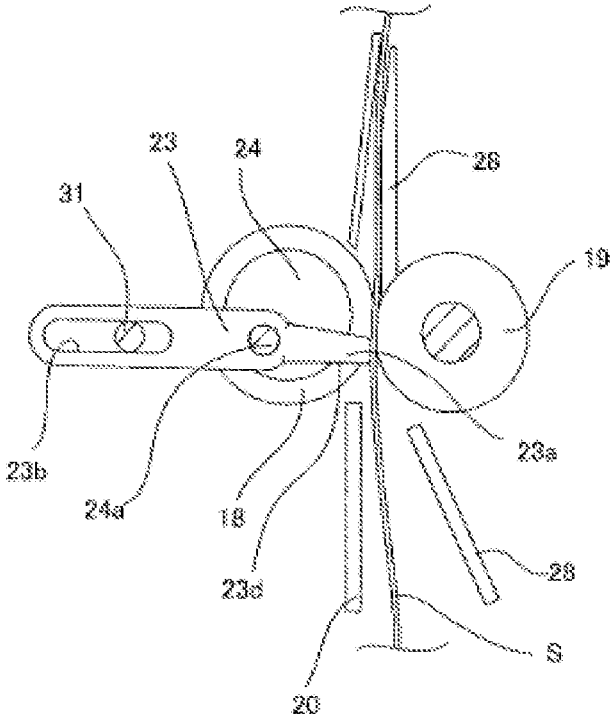
FIG. 9B is a diagram illustrating the shutter member that stands by in a state where the leading end of the abutting portion abuts against the surface of a sheet.

FIG. 7A is a diagram illustrating the skew feeding correction portion 200 in a state where the abutting surface 23*d* of the shutter member 23 is pressed against the sheet S forming a loop and the shutter member 23 rotates. FIG. 7B is a diagram illustrating the shutter member 23 in a state where the sheet S forming a loop is pressed against the sheet S and rotated. FIG. 8A is a diagram illustrating the skew feeding correction portion 200 in a state where the shutter member 23 rotates and the sheet S is nipped by the nip portion. FIG. 8B is a diagram illustrating the shutter member 23 in a state where the sheet S is nipped by the nip portion. FIG. 9A is a diagram illustrating the skew feeding correction portion 200 that stands by in a state where the leading end of the abutting portion 23*a* of the shutter member 23 abuts against the surface of the conveyed sheet S. FIG. 9B is a diagram illustrating the shutter member 23 that stands by in a state where the leading end of the abutting portion 23*a* abuts against the surface of the sheet S.

Figure 10A:
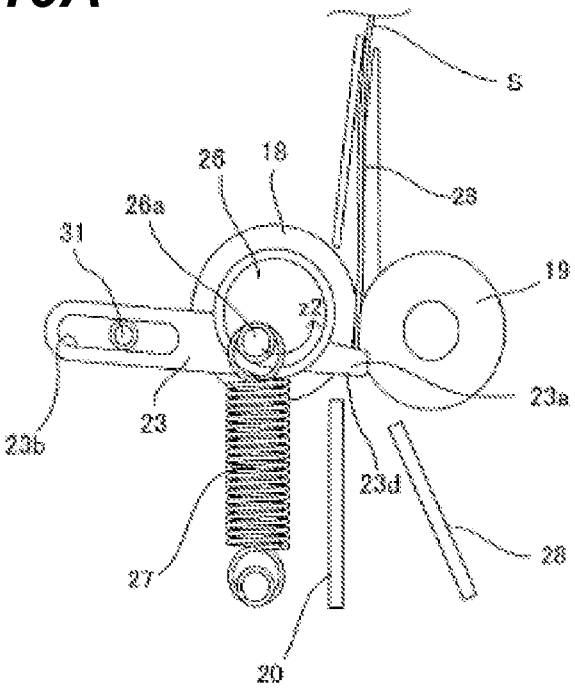
FIG. 10A is a diagram illustrating the skew feeding correction portion in a state where a trailing end of a sheet passes through the leading end of the abutting portion of the shutter member.
Figure 10B:
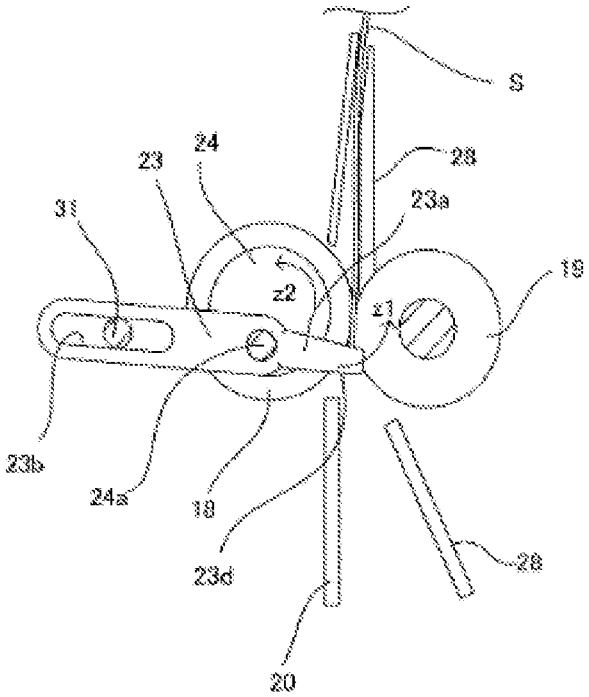
FIG. 10B is a diagram illustrating the shutter member in a state where a trailing end of a sheet passes through the leading end of the abutting portion.
Figure 11A:
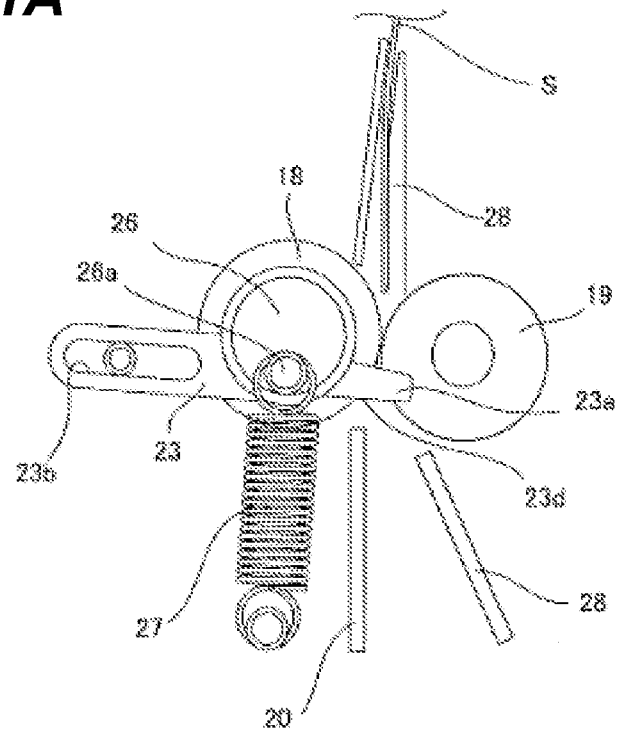
FIG. 11A is a diagram illustrating the skew feeding correction portion in a state where a trailing end of a sheet passes and the abutting portion of the shutter member is positioned at a first position.
Figure 11B:
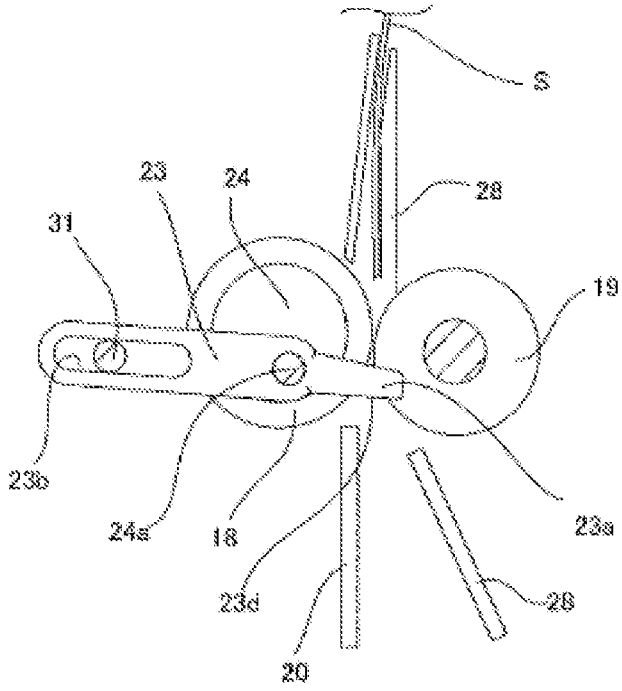
FIG. 11B is a diagram illustrating the shutter member in a state where a trailing end of a sheet passes and the abutting portion is positioned at the first position.
Figure 12:
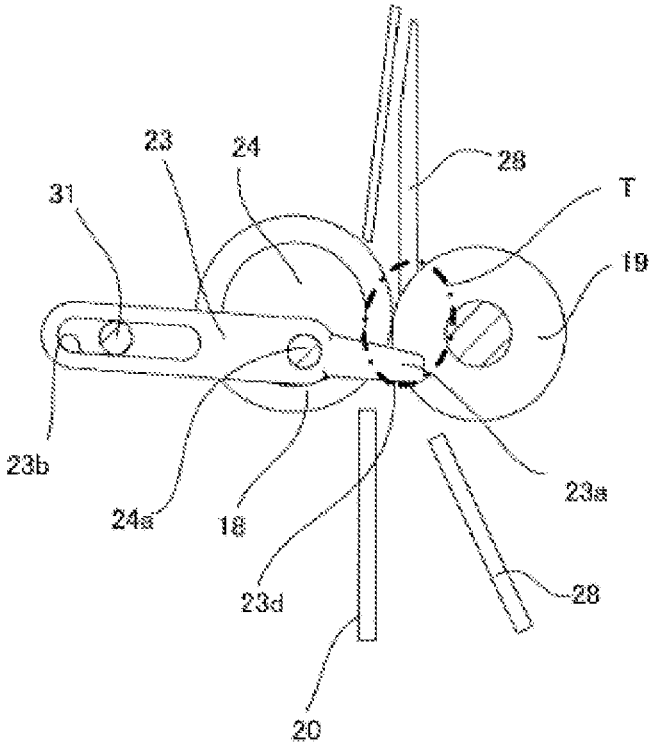
FIG. 12 is a diagram illustrating a rotation trajectory that circularly moves to the first position, a second position, and a third position in a state where the abutting surface faces upstream in a sheet conveying direction.
Figure 13A:
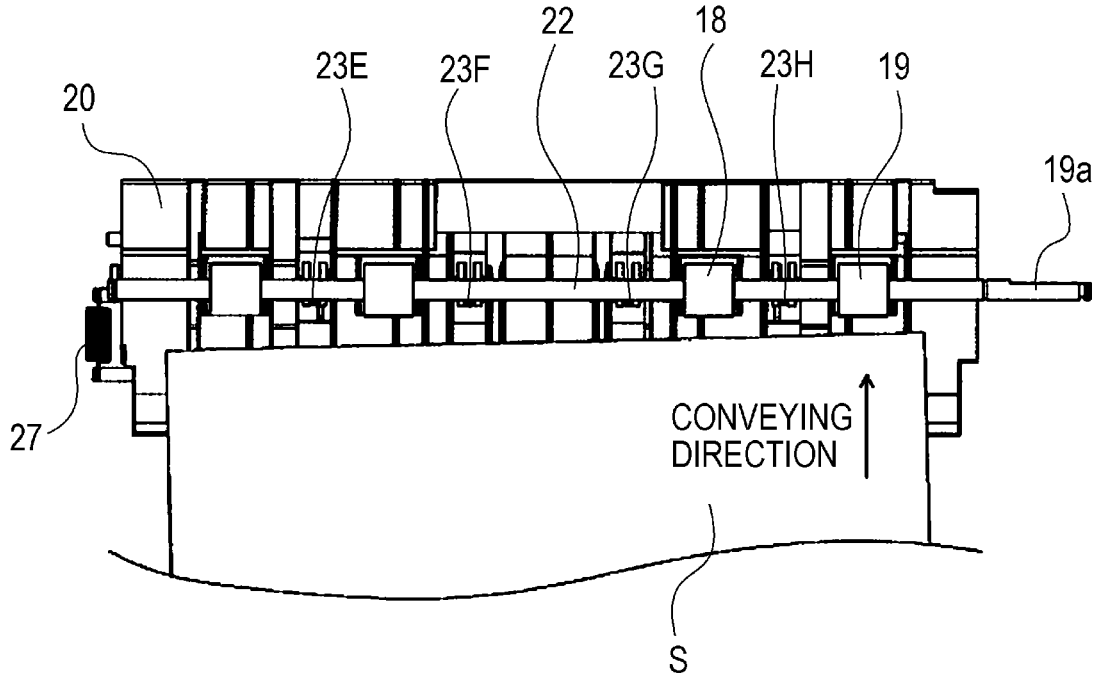
FIG. 13A is a diagram illustrating a state where a skew-fed sheet is conveyed.

FIG. 10A is a diagram illustrating the skew feeding correction portion 200 in a state where the trailing end of the sheet S passes through the leading end of the abutting portion 23*a* of the shutter member 23. FIG. 10B is a diagram illustrating the shutter member 23 in a state where the trailing end of the sheet S passes through the leading end of the abutting portion 23*a*. FIG. 11A is a diagram illustrating the skew feeding correction portion 200 in a state where the trailing end of the sheet S passes and the abutting portion 23*a* of the shutter member 23 is positioned at the first position. FIG. 11B is a diagram illustrating the shutter member 23 in a state where the trailing end of the sheet S passes and the abutting portion 23*a* is positioned at the first position. FIG. 12 is a diagram illustrating a rotation trajectory T that circularly moves to the first position, a second position, and a third position in a state where the abutting surface 23*d* faces upstream in the sheet conveying direction. FIG. 13A is a diagram illustrating a state where the skew-fed sheet S is conveyed.

When the sheet S is conveyed by the sheet conveying portion 8 and the skew-fed sheet S enters into the pair of rollers 18 and 19 as illustrated in FIG. 13A, for example, the sheet S is conveyed in a skew-fed posture if the shutter members 23E to 23H fixed to the shutter shaft 22 are not present. When the sheet S reaches the image forming portion 14 in the skew-fed state (see FIG. 1), the toner image is transferred onto the sheet S while being tilted with respect to the sheet S. In this embodiment, however, the structure in which the shutter members 23E to 23H fixed to the shutter shaft 22 are arranged as described above allows correction of the skew feeding of the sheet S due to an action described later, and prevents transfer of the toner image onto the sheet S while being tilted. The operation of the skew feeding correction portion 200 will be described in detail below.

First, the leading end on the preceding side of the skew-fed sheet S (for example, on the right side illustrated in FIG. 13A) contacts the abutting surface 23*d* of the abutting portion 23*a* provided in the shutter member 23H disposed on the corresponding position (for example, on the right side illustrated in FIG. 13A). At this time, as illustrated in FIGS. 4A and 4B, the shutter member 23 allows the abutting portion 23*a* (abutting surface 23*d*) to protrude to the sheet conveying path and stands by at the first position where the abutting surface 23*d* can abut against leading end of the sheet. In this state, the sheet S is conveyed without being deformed at the leading end of the sheet S, because the sheet S is not in contact with the abutting surface 23*d*.

Next, as illustrated in FIG. 5A, when the leading end of the sheet S contacts the abutting surface 23*d*, the sheet S receives a retention force of the connecting support portion 26*a* to which a force is applied by the shutter spring 27, and an inertia force of each of the pair of rotating members 24 and 25 and the shutter member 23 which are fixed onto the shutter shaft 22. At this time, as illustrated in FIG. 5B, the leading end of the sheet S presses the shutter member 23 against the reaction force and prevents the shutter member 23 from rotating.

When the sheet conveying portion 8 further conveys the sheet S, the leading end on the preceding side of the sheet S abuts against the abutting surface 23*d* of the shutter member 23 to be engaged, and the leading end on the subsequent side sequentially abuts against the abutting surface 23*d* of the plural shutter members 23 to be engaged. That is, the subsequent side of the sheet S sequentially abuts against the shutter member 23H, the shutter member 23G, the shutter member 23F, and the shutter member 23E in this order.

In this process, as illustrated in FIGS. 6A to 7B, the sheet S forms a loop which is curved in a direction indicated by an arrow "y" in the loop formation portion 32 including the guide frame 28 and the sheet frame 20 on the upstream side of the pair of rollers 18 and 19. The curved loop of the sheet S obtained at this time becomes larger on the right side than on the left side as illustrated in FIG. 12A. The series of motions allow the leading end of the sheet S to be in parallel with the abutting surface 23*d* of the shutter member 23 with respect to the rotation axis direction of the pair of rollers 18 and 19, thereby correcting skew feeding of the sheet S. The skew feeding correction performance of the skew feeding correction portion 200 increases when a larger loop is formed in the loop formation portion 32 including the guide frame 28 and the sheet frame 20. That is, as illustrated in FIG. 7B, the loop formation portion 32 may be formed with a larger area. This is because the sheet S forms a loop within the loop formation portion 32 and a part of the loop contacts the guide frame 28, so that the stiffness of the sheet S appears to increase and the shutter member 23 can be pushed up.

Only after the sheet S forms a predetermined loop, a force for moving the abutting surface 23*d* of the shutter member 23 in a direction indicated by an arrow "z1" illustrated in FIG. 6B against the biasing force of the shutter spring 27 is generated depending on the magnitude of the stiffness. At this time, the long hole portion 23*b* is guided to be moved (moved rightward as illustrated in the figures) to each spindle 31 from the position illustrated in FIG. 6B to the position illustrated in FIG. 7B depending on the magnitude of the stiffness of the sheet S. Similarly, the pair of rotating members 24 and 25 and the shutter drive member 26, which retain the shutter member 23, rotate in a direction indicated by the arrow "z2" about the shutter shaft 22, depending on the magnitude of the stiffness of the sheet S. This allows the shutter member 23 to rotate and the leading end of the sheet S to be nipped by the nip portion between the pair of rollers 18 and 19 to be conveyed. That is, the sheet S is nipped by the pair of rollers 18 and 19 during a process in which the sheet S moves the shutter member 23 in a state where the leading end of the sheet S contacts the shutter member 23 and the leading end of the sheet is aligned. As a result, the skew feeding of the sheet nipped by the pair of rollers 18 and 19 is corrected.

Next, when the shutter member 23 further rotates, as illustrated in FIGS. 8A and 8B, the connected portion 23*c* of the shutter member 23 reaches a top dead center (hereinafter referred to as a "second position") of the shutter drive member 26 where a maximum biasing position of the shutter spring 27 is obtained. When the shutter member 23 reaches the second position, a force for allowing the shutter drive member 26 to rotate in the direction indicated by the arrow "z2" switches from the force of the sheet S to press the shutter member 23 to the biasing force of the shutter spring 27 to return the abutting portion 23*a* to the first position. Then, the abutting portion 23*a* of the shutter member 23 is moved by the biasing force of the shutter spring 27 in the direction indicated by the arrow "z1" illustrated in FIG. 8B, and the abutting portion 23*a* retracts from the sheet conveying path and the abutting surface 23*d* retracts from the leading end of the sheet S.

The shutter member 23 moves in the direction indicated by the arrow "z1" illustrated in FIG. 8B by the biasing force of the shutter spring 27, while the sheet S is conveyed by the pair of rollers 18 and 19 (while the sheet is passing through the first position on the sheet conveying path). Accordingly, as illustrated in FIGS. 9A and 9B, the shutter member 23 is caused to stand by in a state where the leading end of the abutting portion 23*a* abuts against the surface of the sheet S (this position is hereinafter referred to as a "third position"), while being biased by the shutter spring 27. After the trailing end of the sheet S passes through the leading end of the abutting portion 23*a*, the shutter member 23 rotates so that the abutting portion 23*a* is positioned at the first position as illustrated in FIGS. 10A and 10B. Further, when the trailing end of the sheet S is separated from the abutting portion 23*a*, the shutter member 23 is in a state where, as illustrated in FIGS. 11A and 11B, the abutting portion 23*a* protrudes to the sheet conveying path and the abutting surface 23*d* stands by at the first position where the leading end of the subsequent sheet is to be aligned.

In this manner, the state illustrated in FIGS. 4A to 11B is repeated, so that the shutter member 23 circularly moves to the first position, the second position, and the third position with the abutting surface 23*d* facing upstream in the sheet conveying direction, while drawing the rotation trajectory T as illustrated in FIG. 12. In other words, the abutting surface 23*d* is allowed to perform an approximate elliptical motion by a rotation in one direction of the pair of rotating members 24 and 25 and the shutter drive member 26.

Figure 13B:
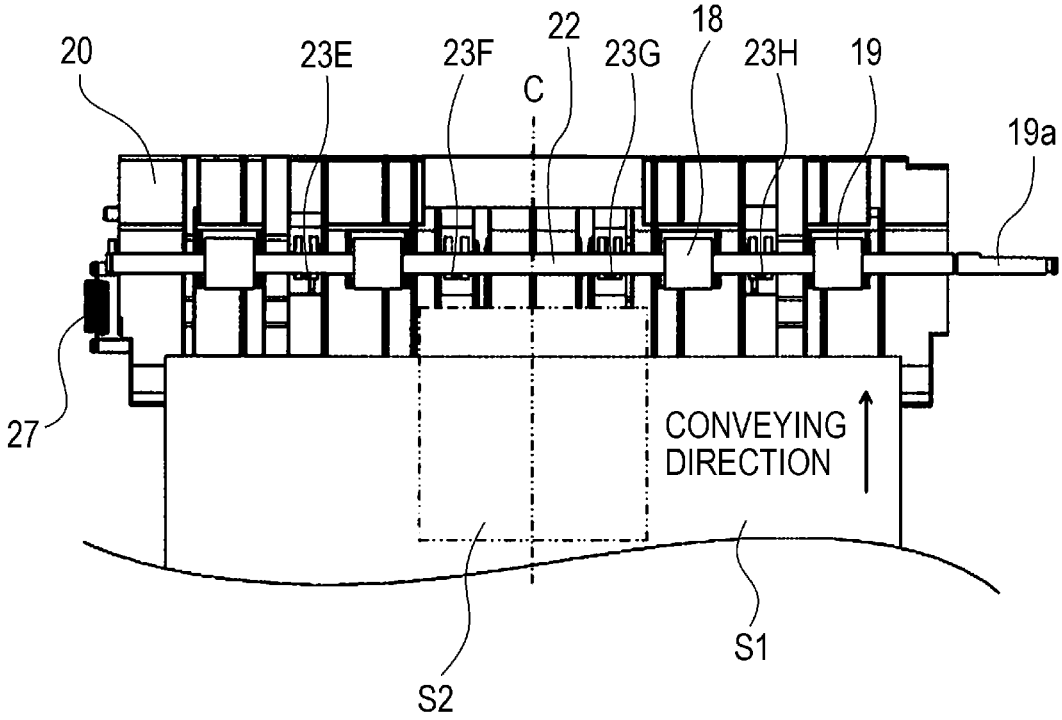
FIG. 13B is a diagram illustrating a state where sheets having different sheet widths are conveyed.

The skew feeding correction in the case where the length in a direction orthogonal to the sheet conveying direction of the sheet to be used (hereinafter referred to as a "sheet width") is relatively large and in the case where the sheet width is relatively small will be described with reference to FIG. 13B. FIG. 13B is a diagram illustrating a state where sheets S1 and S2 having different sheet widths are conveyed.

When the width of the sheet is relatively large (the sheet S1 indicated by the solid line illustrated in FIG. 13B), the two shutter members 23E and 23H, which are arranged so as to correspond to the vicinity of the both side ends of the sheet S1, mainly act on the leading end of the sheet S1, thereby correcting the skew feeding of the sheet S1. On the other hand, when the width of the sheet to be used is relatively small and does not overlap the shutter members 23E and 23H (the sheet S2 illustrated in FIG. 13B), the skew feeding of the sheet S2 is corrected by the shutter members 23F and 23G arranged to be closer to the central portion than the shutter members 23E and 23H.

To obtain the sheet skew feeding correction performance with higher accuracy, the interval between the plural shutter members 23E to 23H corresponding to the width of each sheet may be as large as possible, and the shutter members may be arranged in substantially symmetric with respect to the center of the width of each sheet. This is because a correction angle error of the leading end of each sheet with respect to the rotation axis direction of the pair of rollers 18 and 19 is to be reduced. For this reason, when the shutter member 23 is arranged in the vicinity of the both ends of the sheet to be conveyed, the shutter members 23F and 23G may be arranged also in the vicinity of the convey central portion C of the sheet S2 so as to correct the skew feeding also of the sheet S2 having a relatively small width.

At this time, the interval between the two shutter members 23F and 23G on the both sides in the vicinity of the convey central portion C of the sheet conveying path for the sheet S2 may be set to be smaller than a minimum width of the sheet S2. Furthermore, in this case, the abutting surface 23*d* which abuts against the sheet leading end of the shutter members 23F and 23G may be disposed slightly on the downstream side in the sheet conveying direction with respect to the shutter members 23E and 23H. This prevents the shutter members 23F and 23G from contacting the leading end of the sheet S upon correction of the sheet S1 having a large width, which leads to a reduction in correction angle error. Further, the distance between the abutting surface 23*d* and a nip portion N between the pair of rollers 18 and 19 is reduced to convey the sheet nipped by the nip portion between the pair of rollers 18 and 19 immediately after the skew feeding correction for the sheet is performed by the shutter member 23. Therefore, the sheet skew feeding correction effect can be maintained.

The image forming apparatus 100 according to the first embodiment having the structure described above provides the following advantageous effects. The skew feeding correction portion 200 of the image forming apparatus 100 according to the first embodiment allows the shutter member 23 to circularly move the first position, the second position, and the third position with the abutting surface 23*d* of the shutter member 23 facing upstream, and causes the abutting surface 23*d* of the shutter member 23 to stand by at the third position on the stream side until the sheet passes. Then, when the sheet S passes through the leading end of the shutter member 23, the abutting portion 23*a* is positioned at the first position. Therefore, the time required for the shutter member to return from the position where the sheet S stands by until the abutting portion 23*a* passes to the first position, as compared to the time required for a reciprocating movement in the prior art. As a result, even when the conveying speed of the sheet S increases, an increase in the distance between sheets can be suppressed, so that the abutting portion 23*a* can be returned to the abutting position with a short distance between sheets at a high sheet conveying speed, which has been difficult with the prior art. This results in an improvement in throughput.

For example, in the first embodiment, the distance between sheets can be reduced to about a half of that of the shutter member of the prior art in which the reciprocating operation is carried out. Accordingly, a user's demand for a further improvement in throughput of the image forming apparatus can be satisfied. Furthermore, as illustrated in FIG. 12, the rotation trajectory T of the abutting surface 23*d* of the shutter member 23 can be reduced, thereby enabling arrangement within a location where there are limitations on a space or arrangement, for example.

Also in the first embodiment, the support mechanism including the spindles 31 and the pair of rotating members 24 and 25 rotationally supports the shutter member 23. Accordingly, a rotational driving force can be transmitted to the shutter member 23 with a simple structure. This leads to a reduction in manufacturing costs, for example.

In the skew feeding correction portion 200 according to the first embodiment, the shutter member 23 is disposed such that the rotation center of each of the plural shutter members 23E, 23F, 23G, and 23H and the rotation center of each of the convey rollers 18 are disposed on the same axis. This leads to downsizing of the skew feeding correction portion 200. As a result, the image forming apparatus 100 can be downsized, or the space within the image forming apparatus 100 can be saved. The embodiment described above illustrates an example in which the long hole portion 23*b* is formed in the main body portion 23*e* of the shutter member 23, and the spindle 31 of the sheet frame 20 is fit into the long hole portion 23*b*, and the main body portion 23*e* is slidably supported. Alternatively, a long hole for fitting a pin protruding from the shutter member may be formed in the sheet frame 20 and the main body portion 23*e* of the shutter member 23 may be slidably supported.

Second Embodiment

Next, an image forming apparatus 100A according to a second embodiment of the present invention will be described with reference to FIGS. 14 to 17C while citing FIG. 1. The image forming apparatus 100A according to the second embodiment differs from the first embodiment in that a skew feeding correction portion 200A is provided with a detection sensor portion 30 that detects a rotation position of the shutter member 23. Accordingly, the difference from the first embodiment, i.e., the detection sensor portion 30 that detects the rotation position of the shutter member 23, will be mainly described in the second embodiment. In the second embodiment, the same components as those of the image forming apparatus 100 according to the first embodiment are denoted by the same reference symbols, and the description thereof will not be repeated. In the second embodiment, the same components as those of the first embodiment provide the same advantageous effects as those of the first embodiment.

Figure 14:
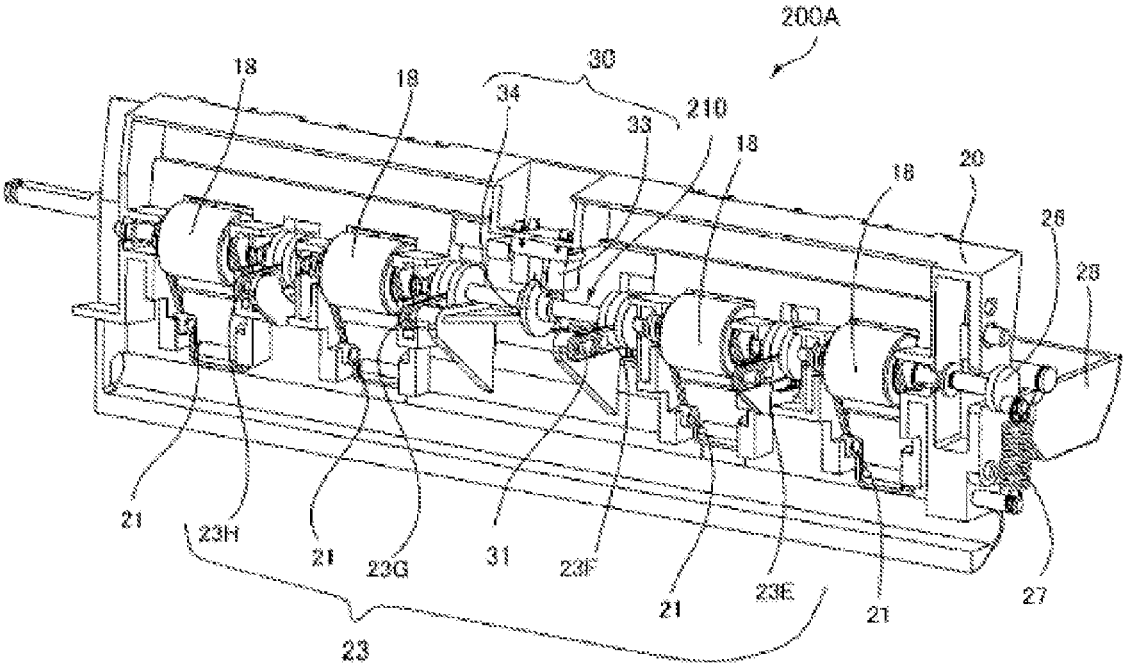
FIG. 14 is a perspective view of a skew feeding correction portion according to a second embodiment of the present invention.
Figure 15A:
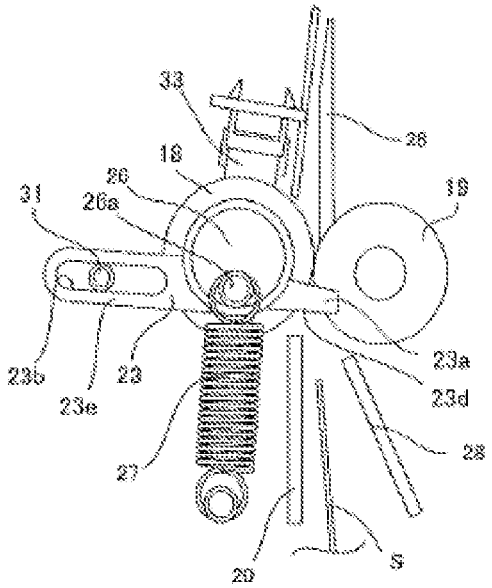
FIG. 15A is a diagram illustrating a state where a sheet is conveyed to the skew feeding correction portion according to the second embodiment.

First, the overall structure of the image forming apparatus 100A according to the second embodiment will be described with reference to FIGS. 14 to 15A while citing FIG. 1. FIG. 14 is a perspective view of the skew feeding correction portion 200A according to the second embodiment. FIG. 15A is a diagram illustrating a state where the sheet S is conveyed to the skew feeding correction portion 200A according to the second embodiment. As illustrated in FIG. 1, the image forming apparatus 100A includes the sheet conveying portion 8, the image forming portion 14, the fixing portion 10, a sheet carrying portion 9A serving as a sheet conveying apparatus, and the sheet discharge portion 13. The sheet carrying portion 9A includes the sheet conveying path 15*a*, the duplex conveying path 15*b*, the pair of skew conveying rollers 16, the pair of U-turn rollers 17, and the skew feeding correction portion 200A. As illustrated in FIG. 14, the skew feeding correction portion 200A includes the plural pairs of rollers 18 and 19, the sheet frame 20, the plural conveying roller springs 21, the guide frame 28, the shutter portion 210, and the detection sensor portion 30.

The detection sensor portion 30 includes a detection sensor 33 and a detection member 34. The detection sensor 33 is an optical sensor (for example, a photosensor) that forms a light path L using a light-emitting element and a light-receiving element, and is attached to the sheet frame 20. The detection sensor 33 is disposed on a rotation path of the detection member 34, and detects a rotation at a determined rotation position of the detection sensor 33 by the detection member 34 blocking the light path L. The detection member 34 is fixed to the shutter shaft 22 by a spring pin or the like (not illustrated), and rotates integrally with the shutter shaft 22 and the shutter member 23. That is, the detection member 34 is provided coaxially with the shutter member 23 and rotates integrally with the shutter member 23.

The skew feeding correction portion 200A corrects skew feeding of the sheet S in the shutter member 23, and the detection member 34 that rotates with the shutter member 23 blocks light received by the detection sensor 33, thereby detecting the leading end position of the sheet S. Further, the image forming apparatus 100A according to the second embodiment causes the image forming portion 14 to start image formation when the skew feeding correction portion 200A detects the leading end position of the sheet S.

Figure 15B:
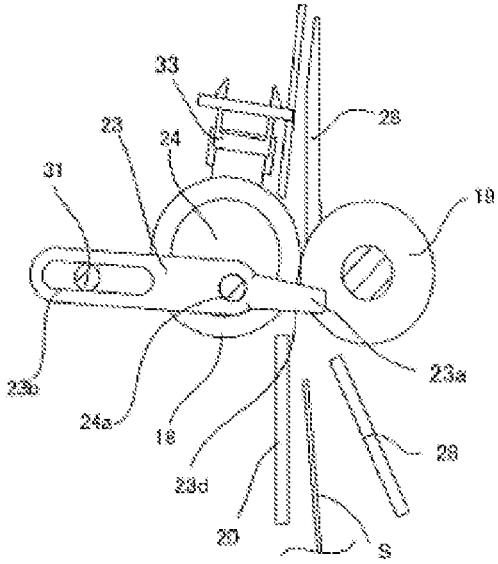
FIG. 15B is a diagram illustrating a shutter member in a state where a sheet is conveyed to the skew feeding correction portion.
Figure 15C:
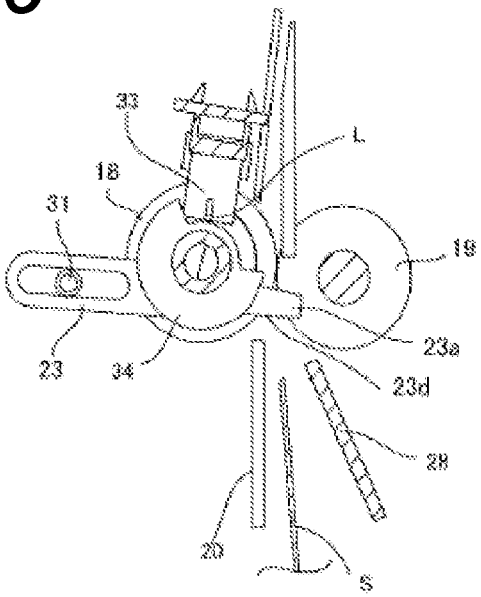
FIG. 15C is a diagram illustrating a detection member in a state where a sheet is conveyed to the skew feeding correction portion.
Figure 16A:
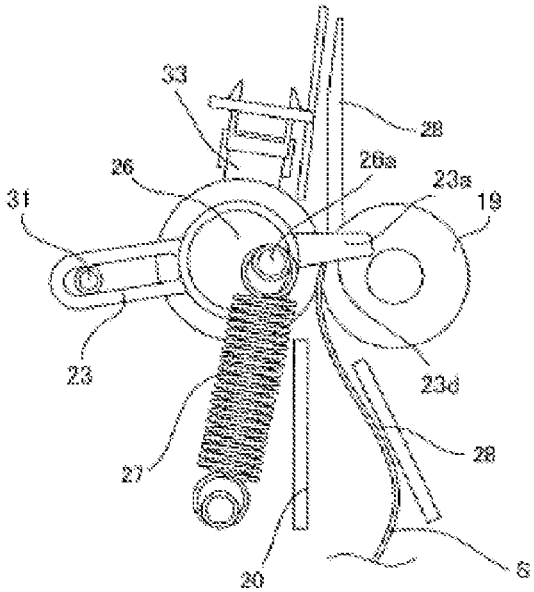
FIG. 16A is a diagram illustrating the skew feeding correction portion in a state where a leading end of a sheet abuts against an abutting surface of the shutter member and the sheet forms a loop.
Figure 16B:
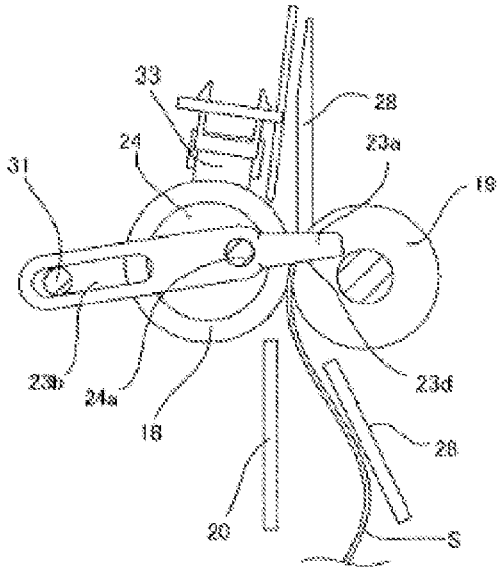
FIG. 16B is a diagram illustrating the shutter member in a state where a leading end of a sheet abuts and the sheet forms a loop.
Figure 16C:
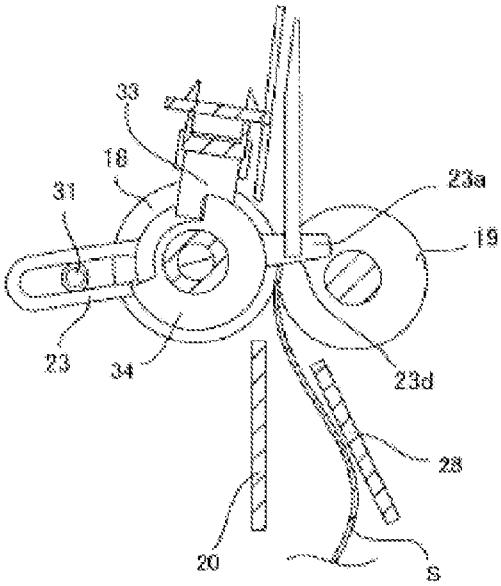
FIG. 16C is a diagram illustrating a detection member in a state where a leading end of a sheet abuts and the sheet forms a loop.

Next, the operation of the skew feeding correction portion 200A will be described with reference to FIGS. 15B to 17C besides FIG. 15A. FIG. 15B is a diagram illustrating the shutter member 23 in a state where the sheet S is conveyed to the skew feeding correction portion 200A. FIG. 15C is a diagram illustrating the detection member 34 in a state where the sheet S is conveyed to the skew feeding correction portion 200A. FIG. 16A is a diagram illustrating the skew feeding correction portion 200A in a state where the leading end of the sheet A abuts against the abutting surface 23*d* of the shutter member 23 and the sheet S forms a loop. FIG. 16B is a diagram illustrating the shutter member 23 in a state where the leading end of the sheet S abuts and the sheet S forms a loop. FIG. 16C is a diagram illustrating the detection member 34 in a state where the leading end of the sheet S abuts and the sheet S forms a loop. FIG. 17 is a diagram illustrating the skew feeding correction portion 200A in a state where the trailing end of the sheet S passes through the leading end of the abutting portion 23*a* of the shutter member 23. FIG. 17B is a diagram illustrating the shutter member 23 in a state where the trailing end of the sheet S passes through the leading end of the abutting portion 23*a*. FIG. 17C is a diagram illustrating the detection member 34 in a state where the trailing end of the sheet S passes through the leading end of the abutting portion 23*a*.

Before the leading end of the sheet S contacts the abutting surface 23*d* of the abutting portion 23*a* of the shutter member 23, the shutter spring 27 and the shutter drive member 26 are stopped in a balanced state as illustrated in FIG. 15A. As illustrated in FIG. 15B, the shutter member 23 stands by at the first position where the shutter member abuts against the leading end of the sheet S. At this time, as illustrated in FIG. 15C, the light path L of the detection sensor 33 is not blocked by the detection member 34 and thus light is allowed to transmit.

When the leading end of the sheet S abuts against the abutting surface 23*d* of the abutting portion 23*a*, the sheet S forms a loop as illustrated in FIG. 16A. As illustrated in FIG. 16B, the sheet S forming a loop allows the shutter member 23 to rotate against the biasing force of the shutter spring 27. When the shutter member 23 rotates and the pair of rollers 18 and 19 conveys the sheet S, the detection member 34 blocks the light path L of the detection sensor 33 as illustrated in FIG. 16C. When the detection member 34 blocks the light path L of the detection sensor 33, the detection sensor 33 determines that the leading end of the sheet S has reached a predetermined position, and transmits a predetermined detection signal to the image forming portion 14. Upon receiving the detection signal, the image forming portion 14 starts an image forming process.

Figure 17A:
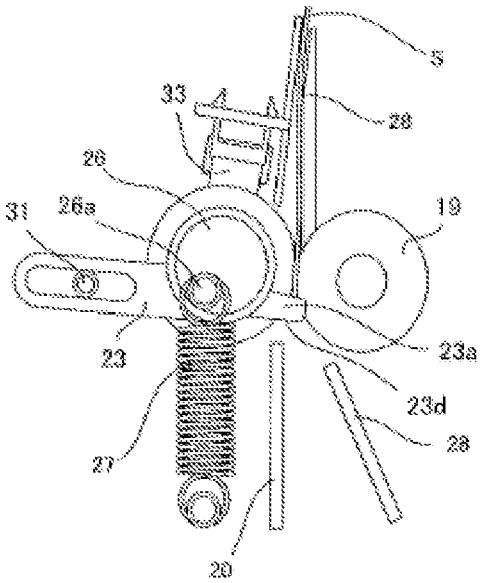
FIG. 17A is a diagram illustrating the skew feeding correction portion in a state where a trailing end of a sheet passes through a leading end of an abutting portion of the shutter member.
Figure 17B:
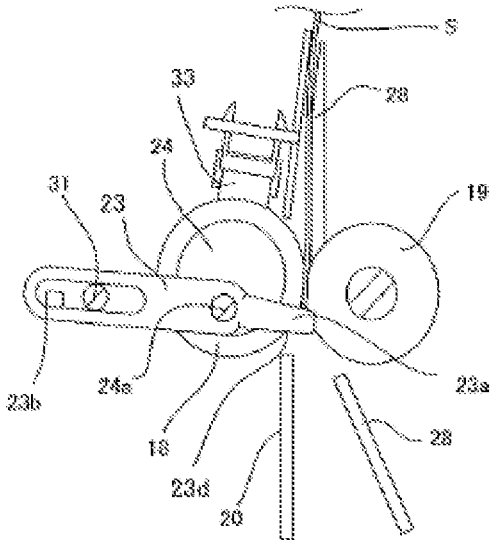
FIG. 17B is a diagram illustrating the shutter member in a state where a trailing end of a sheet passes through the leading end of the abutting portion.
Figure 17C:
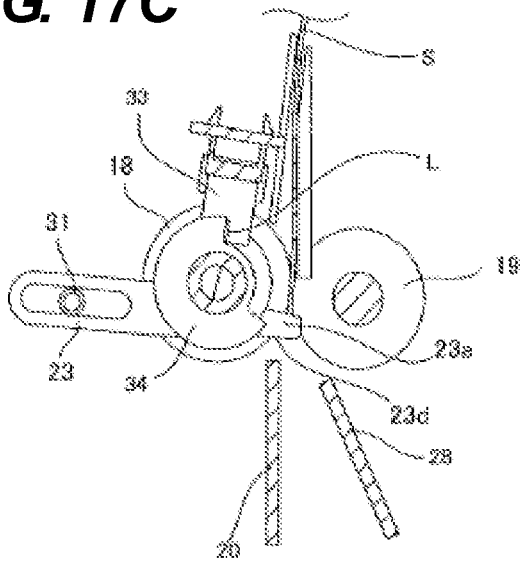
FIG. 17C is a diagram illustrating the detection member in a state where a trailing end of a sheet passes through the leading end of the abutting portion.

After that, as same as the first embodiment, the shutter member 23 sequentially moves to the second position and the third position, and returns to the first position after the trailing end of the sheet S passes through the third position (see FIGS. 17A to 17C). The detection member 34 performs a rotation operation similar to that of the shutter member 23 according to the first embodiment. When the trailing end of the sheet S passes through the leading end of the abutting portion 23*a* and is separated from the shutter member 23, the detection member stands by again at the first position for detecting the leading end of the subsequent sheet S. That is, the light path L of the detection sensor 33 is not blocked by the detection member 34 and thus light is allowed to transmit.

The image forming apparatus 100A according to the second embodiment having the structure described above provides the following advantageous effects. The skew feeding correction portion 200A according to the second embodiment includes the detection sensor 33 and the detection member 34 that rotates integrally with the shutter member 23. Accordingly, the skew feeding correction portion 200A is capable of detecting the leading end position of the sheet S, in addition to correcting skew feeding of the sheet S using the shutter member 23. As a result, the image forming apparatus 100A is capable of interlocking the timing for image formation by the image forming portion 14 with the rotation operation of the shutter member 23. Consequently, the image forming apparatus 100A eliminates the need for separately providing a sheet detection portion for detecting the leading end position of the sheet S, thereby suppressing manufacturing costs, for example.

Third Embodiment

Next, an image forming apparatus 100B according to a third embodiment of the present invention will be described with reference to FIGS. 18 to 22 while citing FIG. 1. The image forming apparatus 100B according to the third embodiment differs from the first embodiment in the shape of the shutter member. Accordingly, the difference from the first embodiment, i.e., a shutter member 323, will be mainly described in the third embodiment. In the third embodiment, the components similar to those of the image forming apparatus 100 according to the first embodiment are denoted by the same reference symbols, and the description thereof will not be repeated. In the third embodiment, the same components as those of the first embodiment provide the same advantageous effects as those of the first embodiment.

Figure 18:
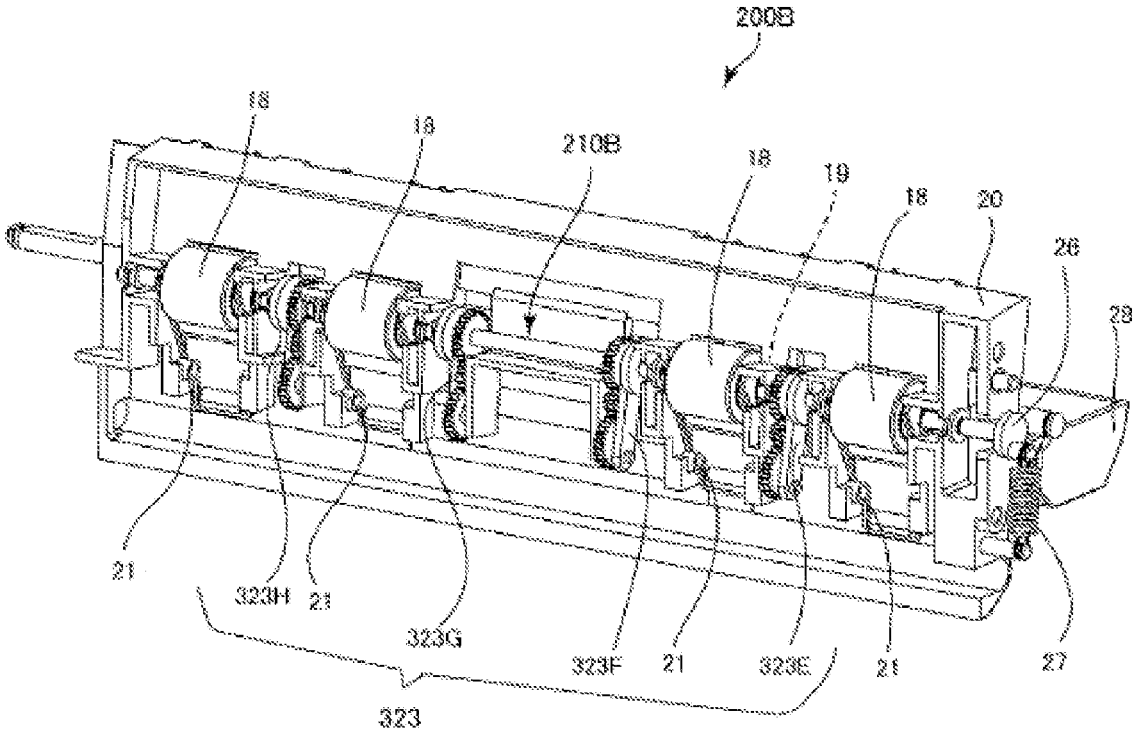
FIG. 18 is a perspective view of a skew feeding correction portion according to a third embodiment of the present invention.
Figure 19:
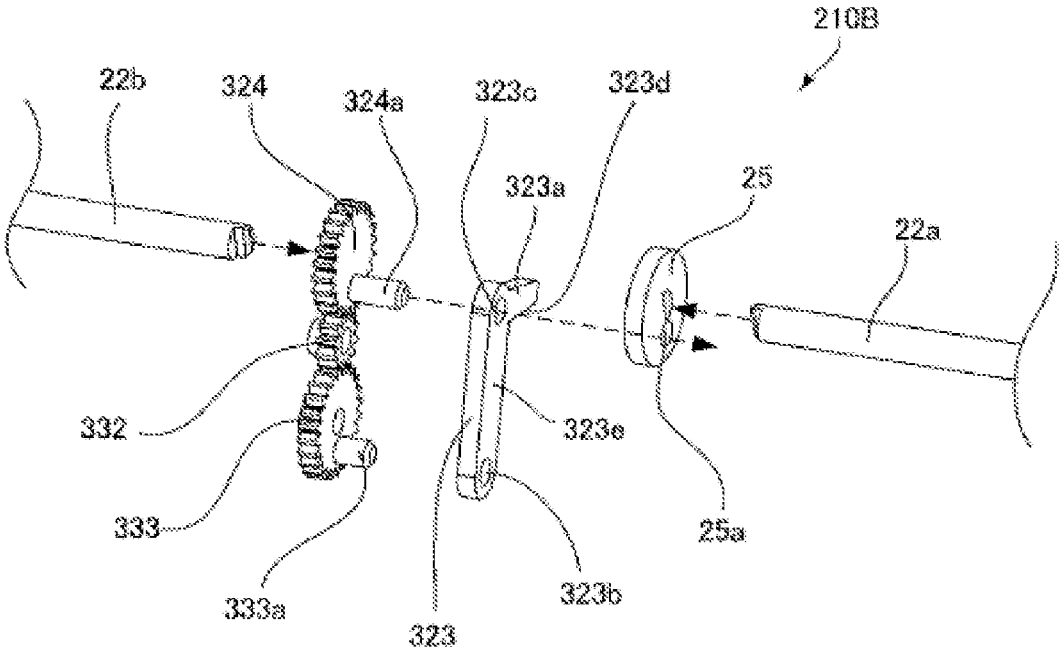
FIG. 19 is an exploded perspective view illustrating a part of a shutter portion of the skew feeding correction portion according to the third embodiment.
Figure 20A:
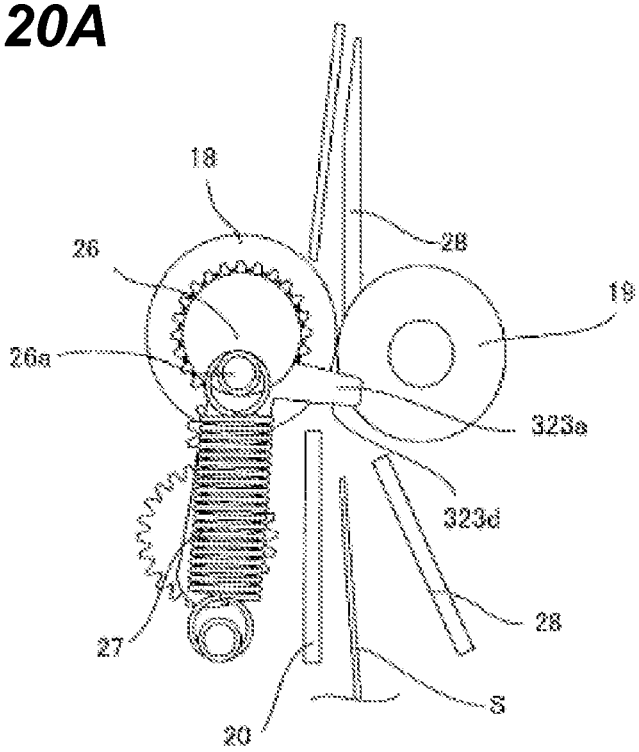
FIG. 20A is a diagram illustrating a state where a sheet is conveyed to the skew feeding correction portion according to the third embodiment.
Figure 20B:
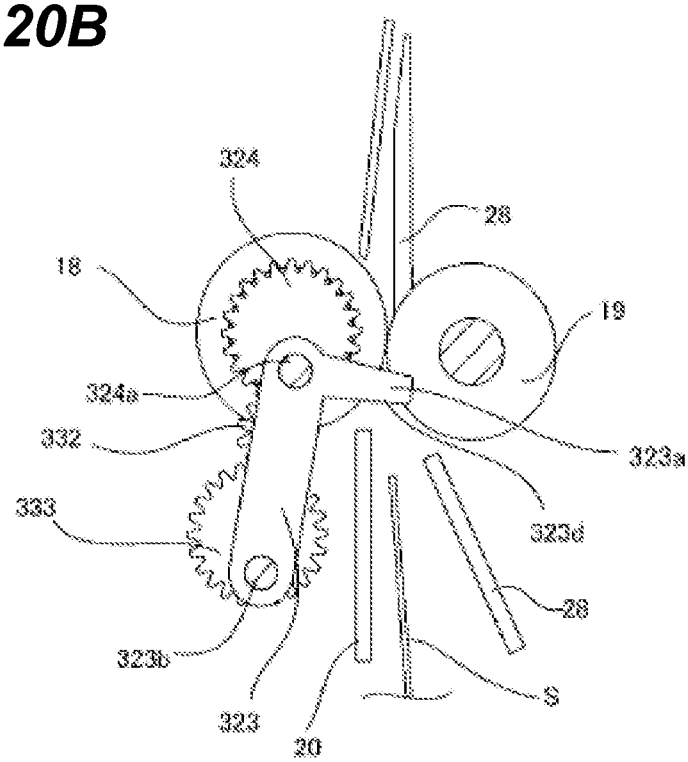
FIG. 20B is a diagram illustrating the shutter member in a state where a sheet is conveyed to the skew feeding correction portion.

First, the overall structure of the image forming apparatus 100B according to the third embodiment will be described with reference to FIGS. 18 to 20B while citing FIG. 1. FIG. 18 is a perspective view of a skew feeding correction portion 200B according to the third embodiment. FIG. 19 is an exploded perspective view illustrating a part of the shutter portion 210B of the skew feeding correction portion 200B according to the third embodiment. FIG. 20A is a diagram illustrating a state where the sheet S is conveyed to the skew feeding correction portion 200B according to the third embodiment. FIG. 20B is a diagram illustrating the shutter member 323 in a state where the sheet S is conveyed to the skew feeding correction portion 200B.

As illustrated in FIG. 1, the image forming apparatus 100B includes the sheet conveying portion 8, the image forming portion 14, the fixing portion 10, a sheet conveying portion 9B serving as a sheet conveying apparatus, and the sheet discharge portion 13. The sheet conveying portion 9B includes the sheet conveying path 15*a*, the duplex conveying path 15*b*, the pair of skew conveying rollers 16, the pair of U-turn rollers 17, and the skew feeding correction portion 200B. As illustrated in FIG. 18, the skew feeding correction portion 200B includes the plural pairs of rollers 18 and 19, the sheet frame 20, the plural conveying roller springs 21, the guide frame 28, and the shutter portion 210B.

The shutter portion 210B includes the plural shutter shafts 22*a* to 22*e*, plural shutter members 323E to 323H, a first gear 324 serving as a first rotating member constituting the support mechanism, and a second gear 333 serving as a second rotating member constituting the support mechanism. The shutter portion 210B also includes an interlocking gear 332 serving as an interlocking member for interlocking the first gear 324 with the second gear 333 so as to rotate in the same direction, the rotating member 25, the shutter drive member 26 serving as a connecting rotation member, and the shutter spring 27.

The plural shutter members 323E to 323H are formed in the same shape. Accordingly, each of the plural shutter members 323E to 323H will be described below as the shutter member 323. As illustrated in FIG. 19, the shutter member 323 includes a main body portion 323*e* formed in a long plate shape, an abutting portion 323*a* formed at one end in the longitudinal direction of the main body portion 323*e*, and a first connected portion 323*b* formed at the other end of the main body portion 323*e*. The shutter member 323 includes a second connected portion 323*c* formed at a position in parallel with the first connected portion 323*b*.

As illustrated in FIGS. 20A and 20B, the abutting portion 323*a* includes an abutting surface 323*d* which is provided so as to protrude to the sheet conveying path at the first position and against which the leading end of the sheet S moving through the sheet conveying path 15*a* can abut at the first position. The abutting surface 323*d* abuts against the leading end of the sheet S and is engaged with the sheet S before the sheet S enters into the nip portion between the pair of rollers 18 and 19. In other words, the abutting portion 323*a* is disposed in a state of protruding to the sheet conveying path so as to be positioned on the upstream side with respect to the nip portion between the pair of rollers 18 and 19, until the leading end of the sheet S abuts against the abutting surface 323*d*. The second connected portion 323*c* is formed in the vicinity of a proximal end portion of the abutting portion 323*a* in the shutter member 323.

The first gear 324 is connected with the shutter shafts 22*a* to 22*e*. The first gear 324 has the D-cut hole formed at the rotation center, and the D-shaped portion formed at the leading end of each of the shutter shafts 22*a* to 22*e* is pressed into the D-cut hole, thereby being connected to the shutter shafts 22*a* to 22*e*. The first gear 324 includes a first connecting shaft 324*a* serving as a first connection portion that extends in parallel with the shutter shafts 22*a* to 22*e* at the position (decentered position) radially offset from the rotation center. The first connecting shaft 324*a* is formed in the second connected portion 323*c* so as to penetrate therethrough. After penetrating the second connected portion 323*c*, the first connecting shaft 324*a* is connected to the connection hole 25*a* of the rotating member 25. This allows the shutter member 323 to rotate with the first gear 324.

The second gear 333 is disposed about an axis in parallel with the first gear 324. The second gear 333 includes a second connecting shaft 333*a* serving as a second connection portion that extends in parallel with the shutter shafts 22*a* to 22*e* at the position (decentered position) radially offset from the rotation center. The second connecting shaft 333*a* is formed in the first connected portion 323*b* so as to penetrate therethrough, and allows the shutter member 323 to rotate with the second gear 333. Note that the first gear 324 and the second gear 333 are formed at a gear ratio of 1:1.

The interlocking gear 332 disposed about an axis in parallel with the first gear 324 and the second gear 333 is engaged with the first gear 324 and the second gear 333, thereby allowing the second gear 333 to be driven and rotated in the same direction as the first gear 324. The first gear 324 and the second gear 333 are rotated in the same direction at the same cycle by the interlocking gear 332.

Figure 21A:
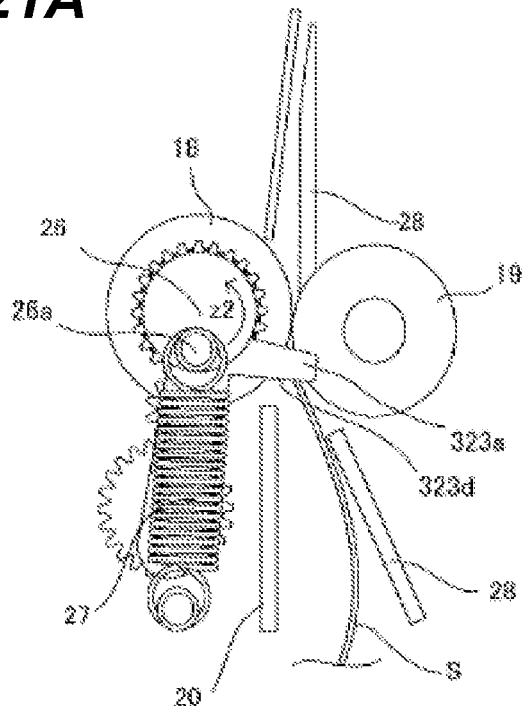
FIG. 21A is a diagram illustrating the skew feeding correction portion in a state where a leading end of a sheet abuts against an abutting surface of the shutter member and the sheet forms a loop.
Figure 21B:
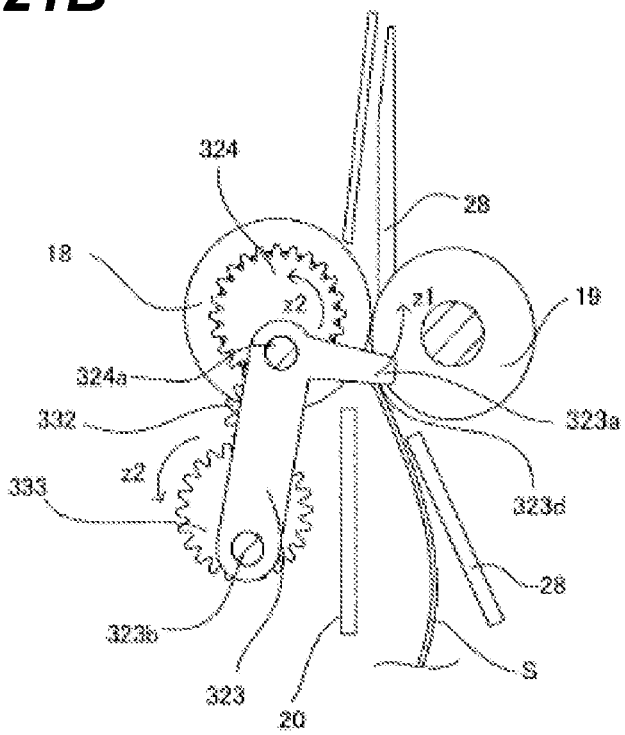
FIG. 21B is a diagram illustrating the shutter member in a state where a leading end of a sheet abuts and the sheet forms a loop.
Figure 22:
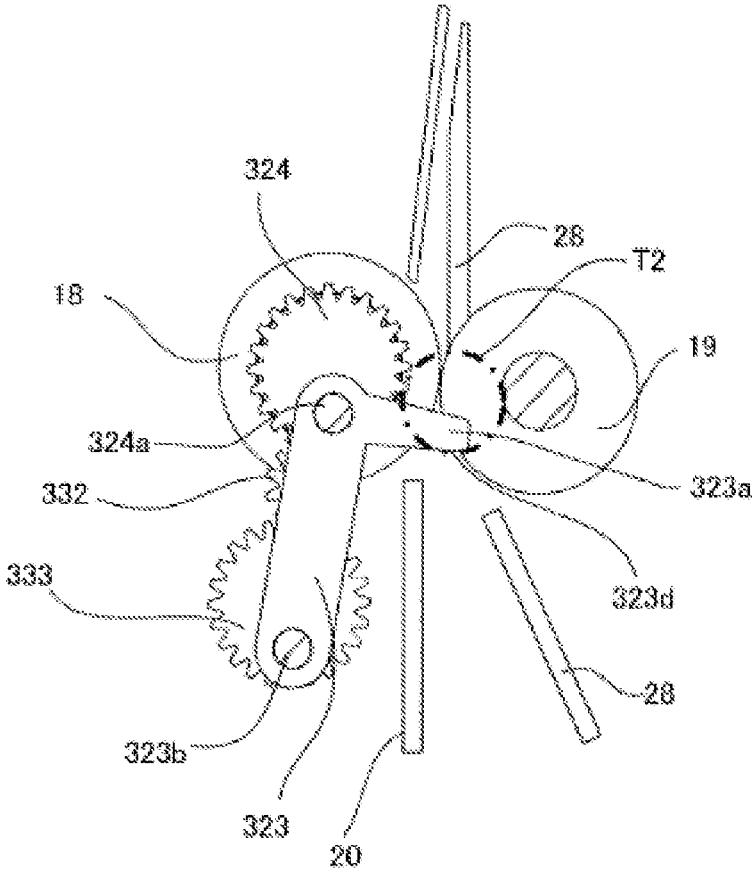
FIG. 22 is a diagram illustrating a rotation trajectory that circularly moves to the first position, the second position, and the third position in a state where the abutting surface faces upstream in the sheet conveying direction.

Next, the operation of the skew feeding correction portion 200B will be described with reference to FIGS. 21A to 22 besides FIGS. 20A and 20B. FIG. 21A is a diagram illustrating the skew feeding correction portion 200B in a state where the leading end of the sheet S abuts against the abutting surface 323*d* of the shutter member 323 and the sheet S forms a loop. FIG. 21B is a diagram illustrating the shutter member 323 in a state where the leading end of the sheet S abuts and the sheet S forms a loop. FIG. 22 is a diagram illustrating a rotation trajectory T2 that circularly moves to the first position, the second position, and the third position in a state where the abutting surface 323*d* faces upstream in the sheet conveying direction.

Before the leading end of the sheet S contacts the abutting surface 323*d* of the abutting portion 323*a* of the shutter member 323, the shutter spring 27 and the shutter drive member 26 are stopped in a balanced state as illustrated in FIG. 20A. Further, as illustrated in FIG. 20B, the shutter member 323 stands by at the first position where the shutter member abuts against the leading end of the sheet S. In this state, the sheet S is not in contact with the abutting surface 323*d*, so that the sheet S is conveyed without being deformed at the leading end of the sheet S.

Referring next to FIGS. 21A and 21B, when the leading end of the sheet S contacts the abutting surface 323*d*, the sheet S receives a reaction force from the shutter portion 210B. At this point of time, the leading end of the sheet S is prevented from pressing the shutter member 323 to be rotated against the reaction force.

When the sheet conveying portion 8 further conveys the sheet S, the leading end on the preceding side of the sheet S abuts against the abutting surface 323*d* of the shutter member 323 to be engaged, and the leading end on the subsequent side sequentially abuts against the abutting surface 323*d* of the plural shutter members 323 to be engaged. In other words, the subsequent side of the sheet S sequentially abuts against the shutter member 323H, the shutter member 323G, the shutter member 323F, and the shutter member 323E in this order. In this process, the sheet S forms a curved loop in the loop formation portion 32 including the guide frame 28 and the sheet frame 20 on the upstream side of the pair of rollers 18 and 19.

Only after the sheet S forms a predetermined loop, a force for moving the shutter member 323 in the direction indicated by the arrow "z1" illustrated in FIG. 21B against the biasing force of the shutter spring 27 is generated depending on the magnitude of the stiffness of the sheet S. At this time, the first gear 324 and the shutter drive member 26, which retain the shutter member 23, rotate in the direction indicated by the arrow "z2" about the shutter shaft 22, depending on the magnitude of the stiffness of the sheet S. When the first gear 324 rotates in the direction indicated by the arrow "z2", the second gear 333 is driven by the first gear 324 to rotate in the direction indicated by the arrow "z2". This allows the shutter member 23 to rotate and the sheet S to be conveyed while the leading end of the sheet S is nipped by the nip portion between the pair of rollers 18 and 19.

After that, as same as the first embodiment, the shutter member 323 sequentially moves to the second position and the third position, and returns to the first position after the trailing end of the sheet S passes through the third position. Thus, by repeating the state illustrated in FIGS. 20A to 21B, the shutter member 323 circularly moves to the first position, the second position, and the third position in a state where the abutting surface 323*d* faces upstream in the sheet conveying direction, while drawing the rotation trajectory T2 illustrated in FIG. 22. In other words, the abutting surface 323*d* is allowed to perform a circular motion by a rotation in one direction of the first gear 324, the second gear 333, and the shutter drive member 26.

The image forming apparatus 100B according to the third embodiment having the structure described above provides the following advantageous effects, in addition to the advantageous effects obtained by the structure similar to the first embodiment. The skew feeding correction portion 200B according to the third embodiment includes the first gear 324 for rotating the shutter member 323, the second gear 333, and the interlocking gear 332. This allows the shutter member 323 to rotate smoothly. As illustrated in FIG. 22, the rotation trajectory T2 of the leading end of the shutter member 323 decreases in the sheet conveying direction (in the vertical direction illustrated in FIG. 22) as compared with the first embodiment, and limitations on the space or arrangement of the image forming apparatus can be further alleviated.

Fourth Embodiment

Next, an image forming apparatus 100C according to a fourth embodiment of the present invention will be described with reference to FIGS. 23 to 26B while citing FIG. 1. The image forming apparatus 100C according to the fourth embodiment differs from the first embodiment in that a shutter cam 435, a shutter spring 427, a pressing member 436, and a cam follower 426 are provided to exert a biasing force on the shutter member 423. Accordingly, the difference from the first embodiment will be mainly described in the fourth embodiment. In the fourth embodiment, the same components as those of the image forming apparatus 100 according to the first embodiment are denoted by the same reference symbols, and the description thereof will not be repeated. In the fourth embodiment, the same components as those of the first embodiment provide the same advantageous effects as those of the first embodiment.

Figure 23:
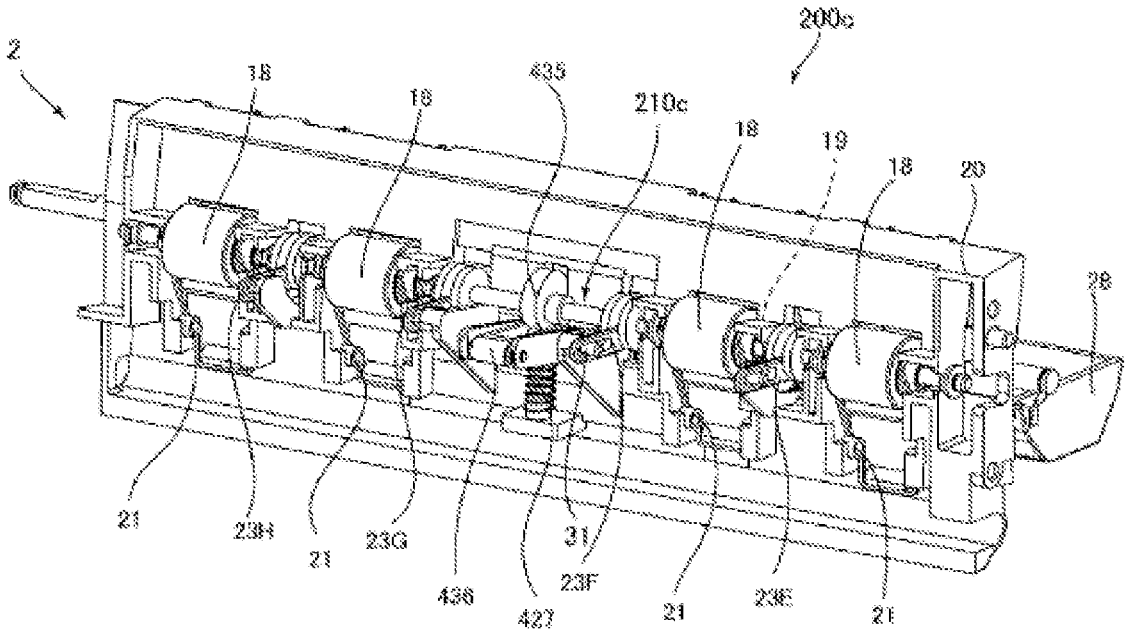
FIG. 23 is a perspective view of a skew feeding correction portion according to a fourth embodiment of the present invention.
Figure 24A:
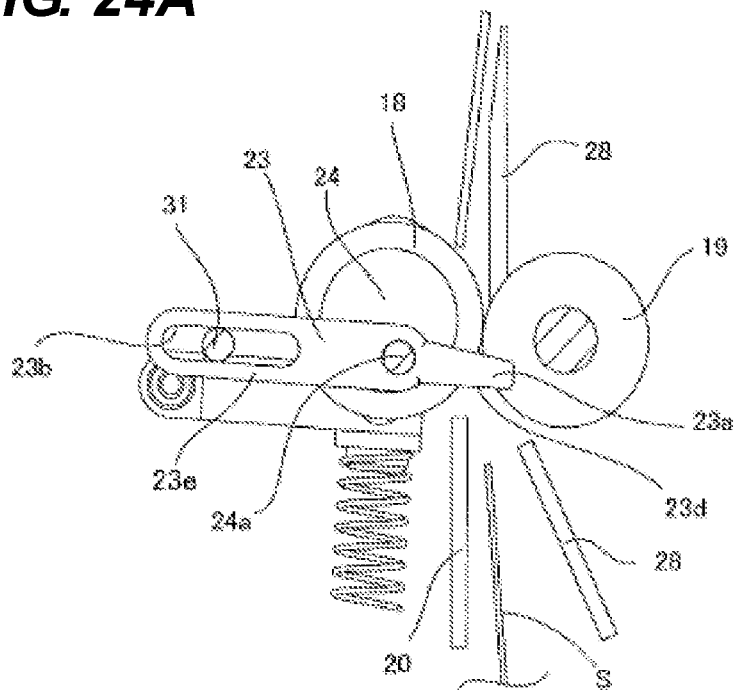
FIG. 24A is a diagram illustrating a shutter member in a state where a sheet is conveyed to the skew feeding correction portion.
Figure 24B:
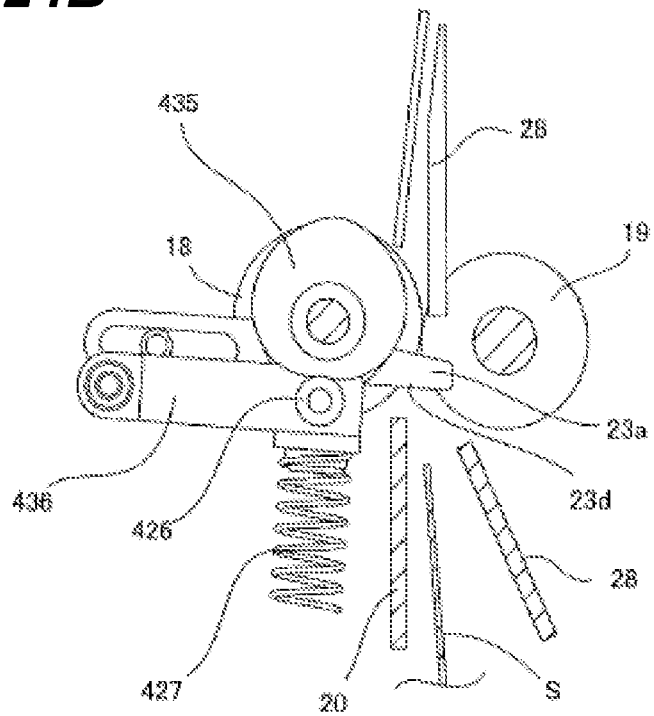
FIG. 24B is a diagram illustrating a state where a sheet is conveyed to the skew feeding correction portion according to the fourth embodiment.

First, the overall structure of the image forming apparatus 100C according to the fourth embodiment will be described with reference to FIGS. 23 to 24B while citing FIG. 1. FIG. 23 is a perspective view of a skew feeding correction portion 200C according to the fourth embodiment. FIG. 24A is a diagram illustrating the shutter member 23 in a state where the sheet S is conveyed to the skew feeding correction portion 200C. FIG. 24B is a diagram illustrating a state where the sheet S is conveyed to the skew feeding correction portion 200C according to the fourth embodiment.

As illustrated in FIG. 1, the image forming apparatus 100C includes the sheet conveying portion 8, the image forming portion 14, the fixing portion 10, a sheet conveying portion 9C serving as a sheet conveying apparatus, and the sheet discharge portion 13. The sheet conveying portion 9C includes the sheet conveying path 15*a*, the duplex conveying path 15*b*, the pair of skew conveying rollers 16, the pair of U-turn rollers 17, and the skew feeding correction portion 200C. As illustrated in FIG. 23, the skew feeding correction portion 200C includes the plural pairs of rollers 18 and 19, the sheet frame 20, the plural conveying roller springs 21, the guide frame 28, and a shutter portion 210C.

The shutter portion 210C includes the plural shutter shafts 22*a* to 22*e*, the plural shutter members 23E to 23H, the plural spindles 31, the plural pairs of rotating members 24 and 25, the shutter spring 427, the shutter cam 435, the pressing member 436, and the cam follower 426. The shutter spring 427, the shutter cam 435, the pressing member 436, and the cam follower 426 constitute a biasing member.

One end of the shutter spring 427 is attached to the sheet frame 20, and the other end of the shutter spring 427 is engaged with the pressing member 436. The pressing member 436 is rotatably attached to the sheet frame 20 at a proximal end portion thereof, and a leading end thereof is engaged with the shutter spring 427. The shutter cam 435 is fixed to the shutter shafts 22*a* to 22*e*, and rotates integrally with the shutter shafts 22*a* to 22*e* about the rotation axis of each of the shutter shafts 22*a* to 22*e*. The shutter cam 435 is formed in a substantially heart shape with partially elevated portions. The cam follower 426 is attached to the pressing member 436 and is engaged with the shutter cam 435.

Figure 25A:
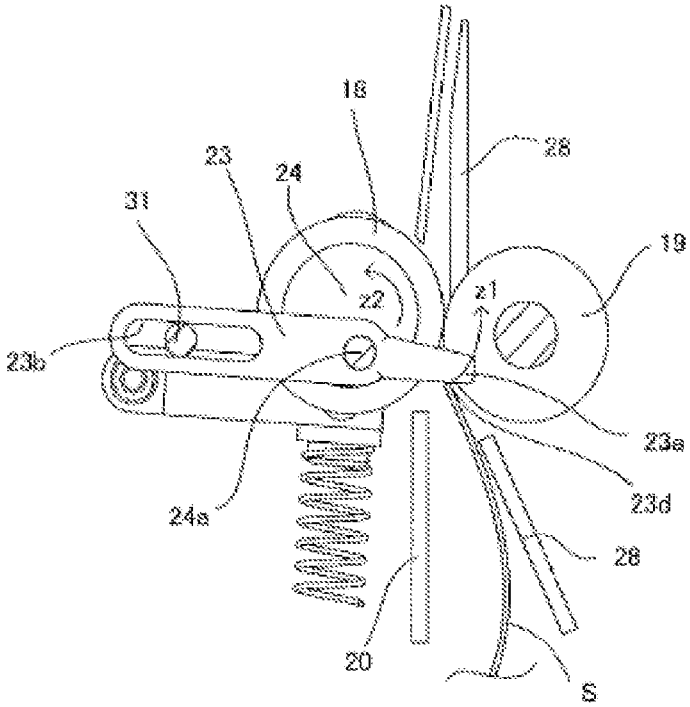
FIG. 25A is a diagram illustrating the shutter member in a state where a leading end of a sheet abuts and the sheet forms a loop.
Figure 25B:
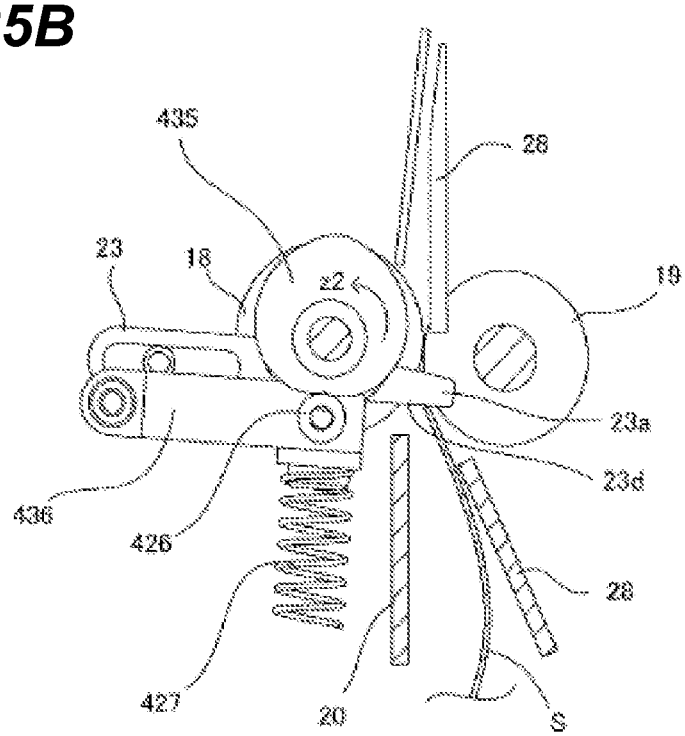
FIG. 25B is a diagram illustrating the skew feeding correction portion in a state where a leading end of a sheet abuts against an abutting surface of the shutter member and the sheet forms a loop.
Figure 26A:
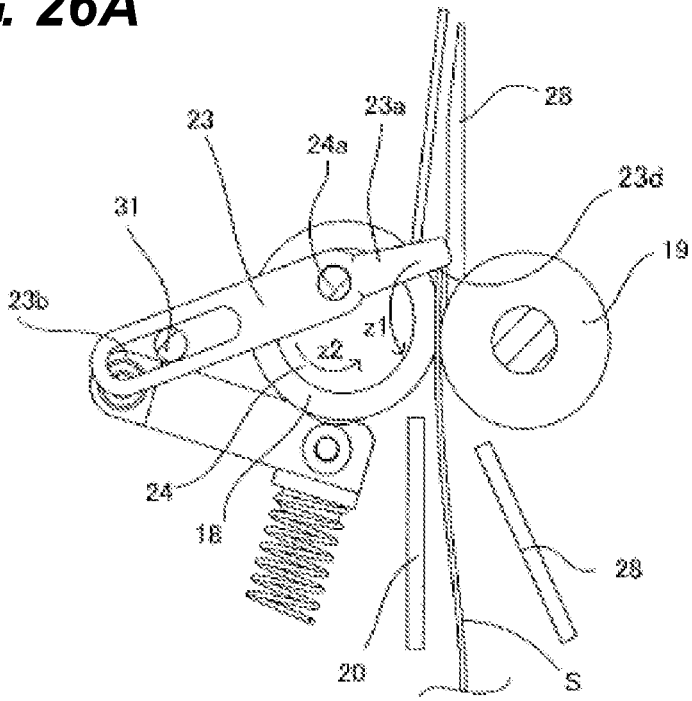
FIG. 26A is a diagram illustrating the shutter member in a state of being pressed against a sheet forming a loop and rotated.
Figure 26B:
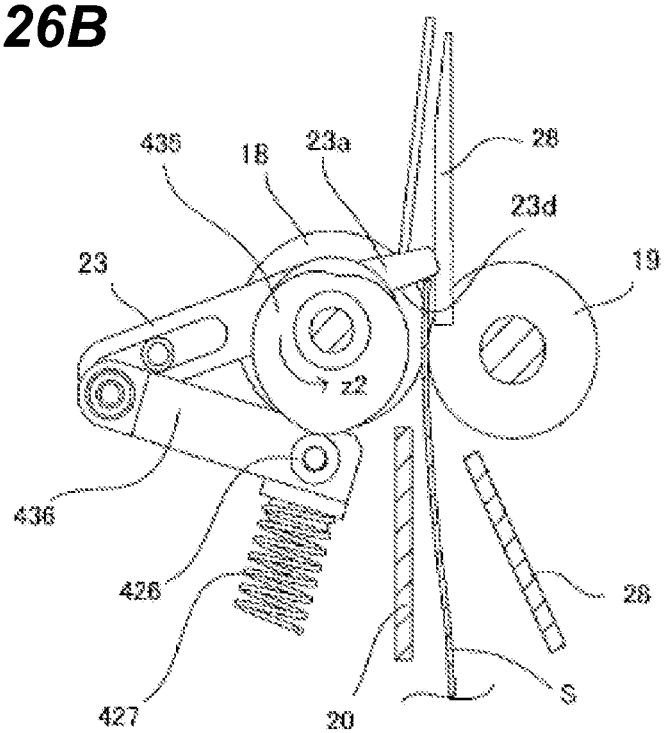
FIG. 26B is a diagram illustrating the skew feeding correction portion in a state where the abutting surface of the shutter member is pressed against a sheet forming a loop and the shutter member rotates.
Figure 27:
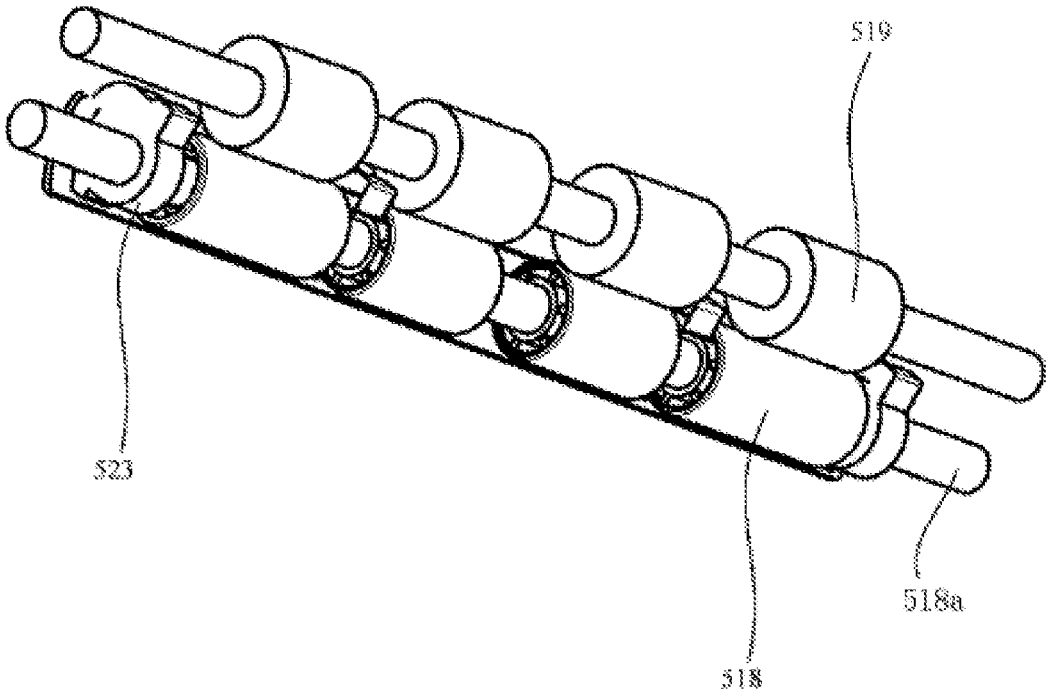
FIG. 27 PRIOR ART
FIG. 27 is a perspective view illustrating a skew feeding correction portion according to an image forming apparatus of a prior art.
Figure 28:
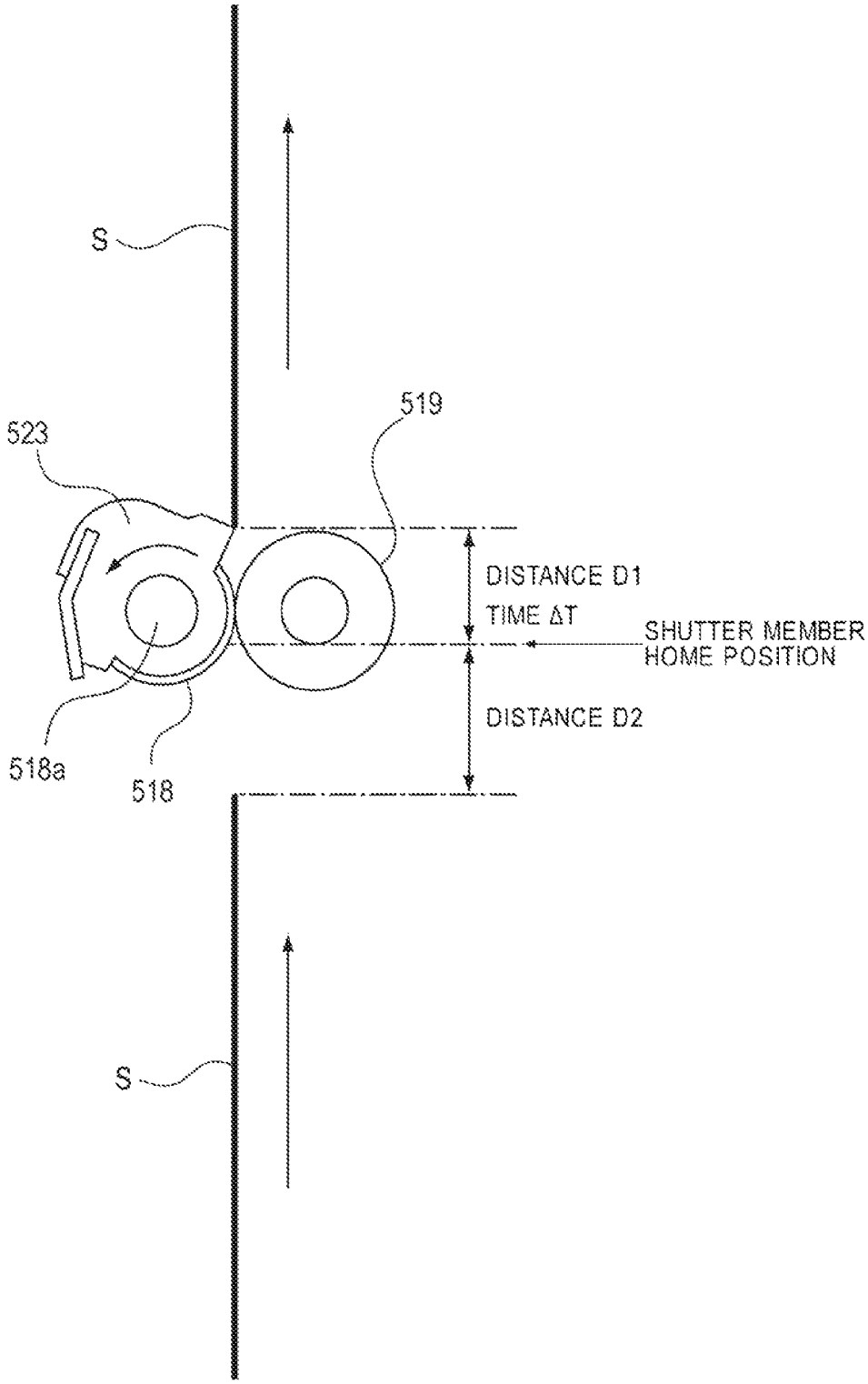
FIG. 28 PRIOR ART
FIG. 28 is a diagram illustrating a state where a leading end of a sheet abuts against a shutter member according to the skew feeding correction portion of the prior art illustrated in FIG. 27.

Next, the operation of the skew feeding correction portion 200C will be described with reference to FIGS. 25A to 26B besides FIGS. 24A and 24B. FIG. 25A is a diagram illustrating the shutter member 23 in a state where the leading end of the sheet S abuts and the sheet S forms a loop. FIG. 25B is a diagram illustrating the skew feeding correction portion 200C in a state where the leading end of the sheet S abuts against the abutting surface 23*d* of the shutter member 23 and the sheet S forms a loop. FIG. 26A is a diagram illustrating the shutter member 23 in a state where the sheet S forming a loop is pressed to be rotated. FIG. 26B is a diagram illustrating the skew feeding correction portion 200C in a state where the abutting surface 23*d* of the shutter member 23 is pressed against the sheet S forming a loop and the shutter member 23 rotates.

As illustrated in FIG. 24B, before the leading end of the sheet S contacts the abutting surface 23*d* of the abutting portion 23*a* of the shutter member 23, the shutter spring 427, the shutter cam 435, the pressing member 436, and the cam follower 426 are stopped in a balanced state. At this time, as illustrated in FIG. 24A, the shutter member 23 stands by at the first position where the shutter member abuts against the leading end of the sheet S. In this state, the sheet S is not in contact with the abutting surface 23*d*, so that the sheet S is conveyed without being deformed at the leading end of the sheet S.

Referring next to FIGS. 25A and 25B, when the leading end of the sheet S contacts the abutting surface 23*d*, the sheet S receives a reaction force from the shutter portion 210C. At this point of time, the leading end of the sheet S cannot press the shutter member 23 to be rotated against the reaction force.

Then, when the sheet conveying portion 8 further conveys the sheet S, the leading end on the preceding side of the sheet S abuts against the abutting surface 23*d* of the shutter member 23 to be engaged, so that the leading end on the subsequent side sequentially abuts against the abutting surface 23*d* of the plural shutter members 23 to be engaged. That is, the subsequent side of the sheet S sequentially abuts against the shutter member 23H, the shutter member 23G, the shutter member 23F, and the shutter member 23E in this order. In this process, the sheet S forms a curved loop in the loop formation portion 32 including the guide frame 28 and the sheet frame 20 on the upstream side of the pair of rollers 18 and 19.

Only after the sheet S forms a predetermined loop, a force for moving the abutting surface 23*d* of the shutter member 23 in the direction indicated by the arrow "z1" illustrated in FIG. 25A against the biasing force of the shutter spring 427 is generated depending on the magnitude of the stiffness of the sheet S. At this time, the long hole portion 23*b* is guided by the spindle 31 to be moved from the position illustrated in FIG. 24A to the position illustrated in FIG. 25A depending on the magnitude of the stiffness of the sheet S (moved rightward illustrated in FIG. 25A). Similarly, as illustrated in FIG. 25B, the pair of rotating members 24 and 25 and the shutter cam 435, which retain the shutter member 23, rotate in the direction indicated by the arrow "z2" about the shutter shaft 22 depending on the magnitude of the stiffness of the sheet S. This allows the shutter member 23 to rotate and the sheet S to be conveyed while the leading end of the sheet S is nipped by the nip portion between the pair of rollers 18 and 19.

Next, when the shutter member 23 further rotates, as illustrated in FIGS. 26A and 26B, the connected portion 23*c* of the shutter member 23 reaches a top dead center (hereinafter referred to as a "second position") of the shutter drive member 26 where a maximum biasing position of the shutter spring 427 is obtained. At this time, the shutter cam 435 rotates so as to press-in the shutter spring 427, the pressing member 436, and the cam follower 426. When the shutter member 23 reaches the second position, the elevated apex of the shutter cam 435 applies a force to the shutter spring 427. After passing through the second position (passing through the apex), the shutter cam 435 rotates in the direction indicated by the arrow "z2" illustrated in FIG. 26B by a reaction force of the shutter spring 427. Along with the rotation, the pair of rotating members 24 and 25 rotates in the "z2" direction, so that the shutter member 23 is moved in the "z1" direction.

After that, as same as the first embodiment, the shutter member 23 sequentially moves to the second position and the third position. After the trailing end of the sheet S passes through the third position, the shutter member 23 returns to the first position. Thus, by repeating the state illustrated in FIGS. 24A to 26B described above, the shutter member 23 circularly moves to the first position, the second position, and the third position in a state where the abutting surface 23*d* faces upstream in the sheet conveying direction.

The image forming apparatus 100C according to the fourth embodiment having the structure described above provides the following advantageous effects, in addition to the advantageous effects provided by the structure similar to that of the first embodiment. The skew feeding correction portion 200C according to the fourth embodiment includes the shutter spring 427 serving as a biasing member, the shutter cam 435, the pressing member 436, and the cam follower 426. This improves the position accuracy in the state of being stopped at the first position, for example.

Though exemplary embodiments of the present invention have been described above, the present invention is not limited to the above embodiments. The advantageous effects described in the embodiments of the present invention are merely exemplary advantageous effects generated by the present invention. The advantageous effects of the present invention are not limited to those described in the embodiments of the present invention.

For example, in this embodiment, the shutter spring is used to allow the shutter member to stand by at the first position, but the present invention is not limited to this. For example, the shutter member may be allowed to stand by at the first position using the gravity by adjusting a weight balance of the shutter member.

In the second embodiment, the detection member 34 is disposed separately, but the present invention is not limited to this. For example, the detection member 34 may be formed integrally with the shutter member 23 or the like.

In the second embodiment, the detection member 34 and the detection sensor 33 detect the sheet S, and image formation is carried out for the sheet based on the signal, but the present invention is not limited to this. For example, the image formation may be carried out first, and an image may be formed depending on the sheet position when the detection sensor 33 detects the sheet S. More alternatively, only a conveyance delay, sheet jamming, or the like of the sheet S may be detected.

In the third embodiment, the interlocking gear 332 is described as the interlocking member, but the present invention is not limited to this. Any connecting member may be used as long as the connecting member can interlock the first gear 324 and the second gear 333 with the rotation in the same direction. For example, a connecting belt or a connecting chain may be used.

In the fourth embodiment, the plural shutter members 23 and the shutter cam 435 are fixed to the shutter shaft 22, but the present invention is not limited to this. For example, the plural shutter members 323 and the shutter cam 435 may be integrally formed. Alternatively, one of the shutter members 323 may be formed integrally with the shutter cam 435.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-004917, filed Jan. 13, 2011, which is hereby incorporated by reference herein in its entirety.

What is claimed is:

1. A sheet conveying apparatus, comprising:

a conveying portion which conveys a sheet;

a shutter member having an abutting surface that abuts against a leading end of the sheet to correct skew feeding of the sheet conveyed by the conveying portion;

a biasing member which applies a biasing force to the shutter member to position at a first position where the leading end abuts against the abutting surface; and a support mechanism which movably supports the shutter member such that the shutter member moves in an order of the first position, a second position, and a third position, while keeping the abutting surface facing upstream in a sheet conveying direction, wherein the second position is a position to which the shutter member moves by the sheet being conveyed against the biasing force of the biasing member, and the third position is a position where the abutting surface is positioned upstream in the sheet conveying direction of a position of the abutting surface at the second position and where the shutter member abuts the surface of the sheet being conveyed and stands by to move to the first position when a trailing end of the sheet passes the shutter member.

2. The sheet conveying apparatus according to claim 1, wherein the support mechanism includes a slide support portion that slidably supports the shutter member, and a rotating member that rotatably supports the shutter member at a connection portion, the connection portion being displaced from a rotation center of the rotating member.

3. The sheet conveying apparatus according to claim 1, wherein the shutter member comprises:

an abutting portion having the abutting surface formed thereon; and a main body portion formed integrally with the abutting portion and linearly formed, the main body portion having a long hole portion formed therein, and the support mechanism comprises:

a spindle slidably engaged with the long hole portion; and a rotating member rotatably connected to the main body portion at a connection portion displaced from a rotation center of the rotating member.

4. The sheet conveying apparatus according to claim 2, wherein the biasing member of which one end is positioned to be fixed, and the other end of the biasing member is connected to the rotating member, and the abutting surface is allowed to perform an approximate elliptical motion by a rotation in one direction of the rotating member.

5. The sheet conveying apparatus according to claim 1, wherein the shutter member comprises:

an abutting portion having the abutting surface formed thereon; and a main body portion which is formed integrally with the abutting portion and includes a first connected portion and a second connected portion, and the support mechanism comprises:

a first rotating member rotatably connected to the first connected portion of the main body portion at a first connection portion displaced from a rotation center of the first rotating member;

a second rotating member rotatably connected to the second connected portion of the main body portion at a second connection disposed to be eccentric from the rotation center of the second rotating member; and an interlocking member for interlocking the first rotating member and the second rotating member to rotate in the same direction.

6. The sheet conveying apparatus according to claim 5, wherein the biasing member of which one end is positioned to be fixed, and the other end of the biasing member is connected to the first rotating member, and the abutting surface is allowed to perform a circular motion by a rotation in one direction of the first rotating member.

7. The sheet conveying apparatus according to claim 2, wherein the rotating member is a cam where the second position is a top dead point and the first position is a bottom dead point, and the biasing member includes a cam follower formed to make contact with the cam swingably and a biasing spring having one end fixedly positioned and the other end connected to the cam follower.

8. The sheet conveying apparatus according to claim 1, further comprising a pair of rollers for nipping a sheet during a movement of the shutter member while being pressed against the sheet in a state where the leading end of the sheet abuts against the abutting surface.

9. An image forming apparatus, comprising:

a conveying portion which conveys a sheet;

a shutter member having an abutting surface that abuts against a leading end of the sheet to correct skew feeding of the sheet conveyed by the conveying portion;

a biasing member which applies a biasing force to the shutter member to position at a first position where the leading end abuts against the abutting surface;

a support mechanism which movably supports the shutter member such that the shutter member moves in an order of the first position, a second position, and a third position, while keeping the abutting surface facing upstream in a sheet conveying direction, wherein the second position is a position to which the shutter member moves by the sheet being conveyed against the biasing force of the biasing member, and the third position is a position where the abutting surface is positioned upstream in the sheet conveying direction of a position of the abutting surface at the second position and where the shutter member abuts the surface of the sheet being conveyed and stands by to move to the first position when a trailing end of the sheet passes the shutter member; and an image forming portion which forms an image on the sheet fed from the sheet conveying apparatus.

10. A sheet conveying apparatus, comprising:

a conveying portion which conveys a sheet;

a shutter member having an abutting surface that abuts against a leading end of the sheet;

a pair of rollers which nips a sheet during a movement of the shutter member while being pressed against the sheet in a state where the leading end of the sheet abuts against the abutting surface;

a biasing member which applies a biasing force to the shutter member to position the shutter member at a position where the leading end abuts against the abutting surface; and a support mechanism which movably supports the shutter member so that the shutter member performs a crank-movement.

11. The sheet conveying apparatus according to claim 10, wherein the support mechanism includes a rotating member that rotatably supports the shutter member at a connection portion, the connection portion being displaced from a rotation center of the rotating member.

12. The sheet conveying apparatus according to claim 11, wherein the support mechanism includes a slide support portion that slidably supports the shutter member.

13. The sheet conveying apparatus according to claim 11, wherein the shutter member comprises:

an abutting portion having the abutting surface formed thereon; and a main body portion formed integrally with the abutting portion, the main body portion having a long hole portion formed therein, and the support mechanism further comprising a spindle slidably engaged with the long hole portion.

14. The sheet conveying apparatus according to claim 11, wherein one end of the biasing member is positioned to be fixed, and the other end of the biasing member is connected to the rotating member, and the abutting surface is allowed to perform an approximate elliptical motion by a rotation in one direction of the rotating member.

15. The sheet conveying apparatus according to claim 11, wherein the support mechanism further comprises, a second rotating member rotatably connected to a second connected portion of the shutter member portion at a second connection displaced from the rotation center of the second rotating member; and an interlocking member for interlocking the rotating member and the second rotating member to rotate in the same direction.

16. The sheet conveying apparatus according to claim 15, wherein the biasing member of which one end is positioned to be fixed, and the other end of the biasing member is connected to the rotating member.

17. The sheet conveying apparatus according to claim 11, wherein the rotating member is a cam where the second position is a top dead point and the first position is a bottom dead point, and the biasing member includes a cam follower formed to make contact with the cam swingably and a biasing spring having one end fixedly positioned and the other end connected to the cam follower.

* * * * *